US007079781B2

(12) United States Patent
Suzuki et al.

(10) Patent No.: US 7,079,781 B2
(45) Date of Patent: Jul. 18, 2006

(54) IMAGE FORMING APPARATUS AND IMAGE FORMING METHOD

(75) Inventors: Chikatsu Suzuki, Hachioji (JP); Kenichi Ozawa, Hachioji (JP); Susumu Kurihara, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 81 days.

(21) Appl. No.: 10/943,552

(22) Filed: Sep. 17, 2004

(65) Prior Publication Data

US 2005/0105924 A1 May 19, 2005

(30) Foreign Application Priority Data

Oct. 14, 2003 (JP) ..... 2003-353537
Oct. 14, 2003 (JP) ..... 2003-353547
Aug. 10, 2004 (JP) ..... 2004-233497

(51) Int. Cl.
*G03G 15/00* (2006.01)

(52) U.S. Cl. ..... 399/45; 399/69; 399/364; 399/81; 399/82; 399/393; 399/391

(58) Field of Classification Search ..... 399/45, 399/46, 67, 69, 81–83, 85, 86, 364, 374, 399/391, 393, 401
See application file for complete search history.

(56) References Cited

U.S. PATENT DOCUMENTS 5,999,765 A * 12/1999 Tomita ..... 399/69
6,937,828 B1 * 8/2005 Hasegawa et al. ..... 399/69

* cited by examiner

*Primary Examiner*—Hoang Ngo

(57) ABSTRACT

An image forming apparatus includes: a recording-media supplying tray for storing a recording medium; a print section for printing an image on the recording medium; a storing section for storing an adjustment value for a printing of the image in the print section related to a type of the recording medium or the recording-media supplying tray for each of two sides of the recording medium; and a control section for controlling the print section so that the printing of the image is adjusted for each of the two sides depending on the adjustment value for each of the two sides, which is stored in the storing section.

72 Claims, 14 Drawing Sheets

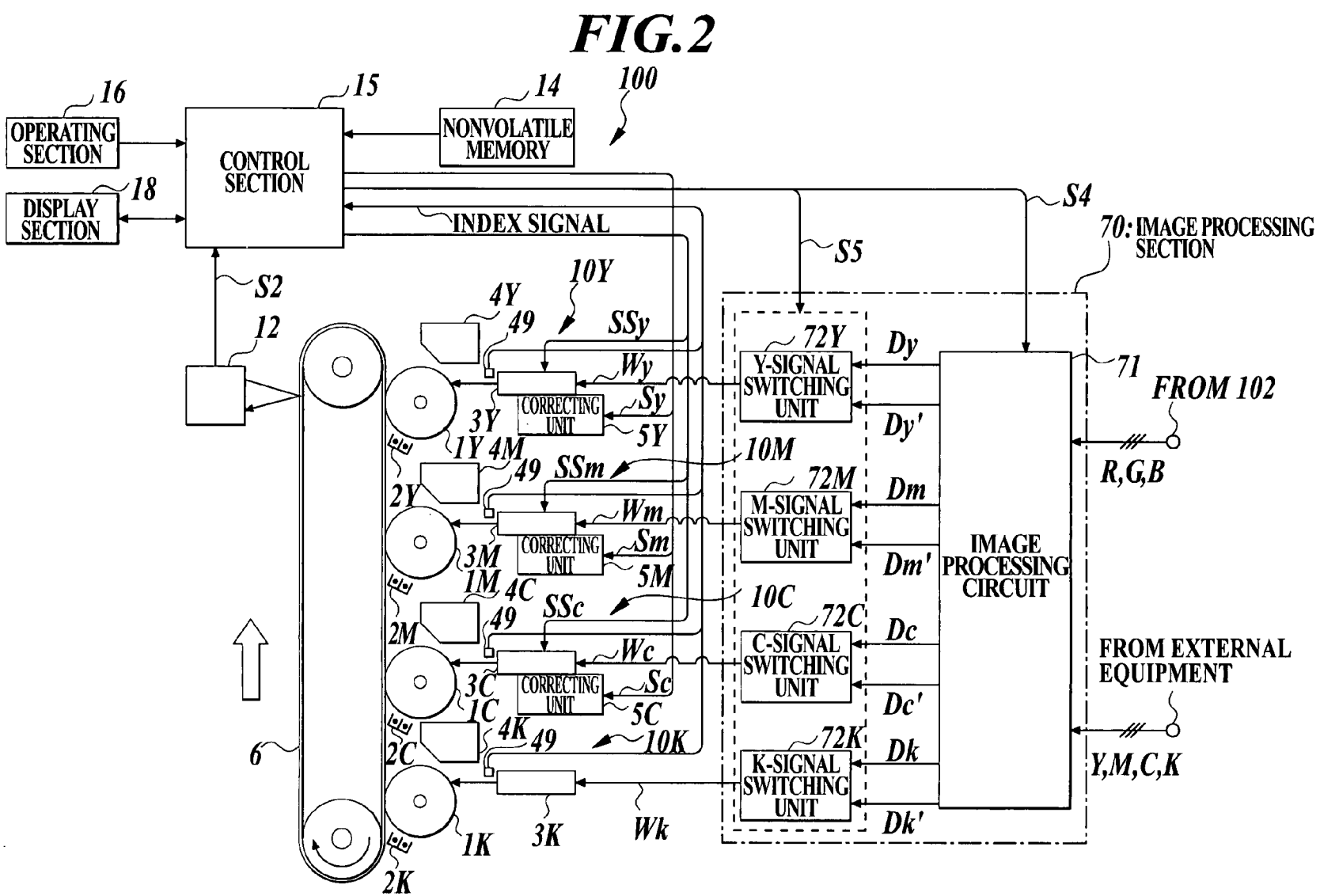
FIG. 2
70: IMAGE PROCESSING SECTION
71
FROM 102
R,G,B
FROM EXTERNAL EQUIPMENT
Y,M,C,K
IMAGE PROCESSING CIRCUIT
Dy
Dy'
Dm
Dm'
Dc
Dc'
Dk
Dk'
72Y
Y-SIGNAL SWITCHING UNIT
72M
M-SIGNAL SWITCHING UNIT
72C
C-SIGNAL SWITCHING UNIT
72K
K-SIGNAL SWITCHING UNIT
S4
S5
S2
100
10Y
10M
10C
10K
SSy
SSm
SSc
Wy
Wm
Wc
Wk
Sy
Sm
Sc
5Y
5M
5C
CORRECTING UNIT
3Y
3M
3C
3K
1Y
1M
1C
1K
2Y
2M
2C
2K
4Y
4M
4C
4K
49
6
12
14
NONVOLATILE MEMORY
INDEX SIGNAL
15
CONTROL SECTION
16
OPERATING SECTION
18
DISPLAY SECTION

FIG.3

FIXING TEMPERATURE OBTAINED FROM PAPER TYPE AND PAPER BASIS WEIGHT (FRONT SIDE PRINT TEMPERATURE[℃]/BACK SIDE PRINT TEMPERATURE[℃])

| | | PAPER BASIS WEIGHT($g/m^2$) | | | | | |
|---|---|---|---|---|---|---|---|
| | | 0-50 | 51-100 | 101-150 | 151-200 | 201-250 | 251-300 |
| PAPER TYPE | NORMAL PAPER | 200/200 | 200/200 | 205/205 | 205/205 | 210/205 | 210/210 |
| | RECYCLED PAPER | 190/190 | 195/195 | 195/195 | 195/195 | 200/200 | 200/200 |
| | COATED PAPER | 200/195 | 200/195 | 200/195 | 200/200 | 200/200 | 200/200 |

IMAGE FORMING APPARATUS AND IMAGE FORMING METHOD

BACKGROUND OF THE INVENTION

1. Field of the Invention

The present invention relates to an image forming apparatus, such as a printer and a multifunctional, and an image forming method that are provided with a plurality of recording-media-supplying trays and are capable of duplex printing on a recording-media supplied by the recording-media-supplying trays.

2. Description of Related Art

In the past, image forming apparatuses, such as printers and multifunctionals, which can print on a recording medium for printing, such as paper, at various print magnification has been developed. For example, a development for forming images with print adjustment for setting a desired print magnification owing to adjustment of scanning rate is disclosed in JP-Tokukai-2002-305653A.

In recent years, image forming apparatuses, such as printers and multifunctional, that is capable of image-forming by xerography have been used, and more elaborate print adjustment (print magnification adjustment, print position adjustment and the like) has been required. In particular, print adjustment for underprint is essential for cases of duplex printing because printing a reverse side after printing a front side causes temperature of a printer sheet at the reverse printing to become higher than that at the front printing and so the size of printer is changed.

The print adjustment generally varies depending on a kind of recording-media for printing. Recently, kinds of recording-media for printing have become diverse (for example, printer sheet, OHP (OverHead Projector) sheet, and so on). Even printer sheet has various kinds used depending on its material, basis weight, size, thickness, coated/uncoated, and the like. Demands for high image quality require setting of print adjustment values depending on the above-described paper types at each print processing.

SUMMARY OF THE INVENTION

An object of the present invention is to improve operationality of print adjustment, and thus to obtain easily high quality images, in an image forming apparatus capable of duplex printing.

To solve the above-described problem, in accordance with the first aspect of the present invention, an image forming apparatus comprising:

a recording-media supplying tray for storing a recording medium;

a print section for printing an image on the recording medium;

a storing section for storing an adjustment value for a printing of the image in the print section related to a type of the recording medium or the recording-media supplying tray for each of two sides of the recording medium; and a control section for controlling the print section so that the printing of the image is adjusted for each of the two sides depending on the adjustment value for each of the two sides, which is stored in the storing section.

In accordance with the second aspect of the present invention, an image forming apparatus comprises:

a plurality of recording-media supplying trays for storing a recording medium for printing;

a storing section for storing an adjustment standard value group containing a plurality of adjustment standard values and an adjustment value group containing a plurality of adjustment values for changing the adjustment standard values of the adjustment standard value group so as to relate the adjustment standard value group and the adjustment value group to the recording-media supplying trays, respectively; and a control section for taking control so that print adjustment for the recording medium supplied from the recording-media supplying tray related to the adjustment standard value group and the adjustment value group is performed based on the adjustment standard value group and adjustment value group for each of two sides of the recording medium, wherein the control section gives a name representing the adjustment value group to the adjustment value group to store the adjustment value group in the storing section and to read out the adjustment value group based on the name.

In accordance with the third aspect of the present invention, an image forming apparatus comprises:

a plurality of recording-media supplying trays for storing a recording medium for printing;

a storing section for storing an adjustment standard value group containing a plurality of adjustment standard values and an adjustment value group containing a plurality of adjustment values for changing the adjustment standard values of the adjustment standard value group so as to relate the adjustment standard value group and the adjustment value group to the recording-media supplying trays, respectively; and a control section for taking control so that print adjustment for the recording medium supplied from the recording-media supplying tray related to the adjustment standard value group and the adjustment value group is performed based on the stored adjustment standard value group and adjustment value group for each of two sides of the recording medium, wherein in a case that the predetermined adjustment value group is related to any one of the plurality of recording-media supplying trays and stored in the storing section, the control section takes control so that information showing the case is displayed on a screen for inputting an instruction of a basic operation so as to relate the information to the recording-media supplying tray.

In accordance with the forth aspect of the present invention, an image forming method for image forming by controlling an image forming apparatus comprising:

a recording-media supplying tray for storing a recording medium;

a print section for printing an image on the recording medium; and a storing section for storing an adjustment value for a printing of the image in the print section related to a type of the recording medium or the recording-media supplying tray for each of two sides of the recording medium, the apparatus being capable of print adjustment of the recording medium supplied from the recording-media supplying tray related to the adjustment value based on the adjustment value for each of two sides of the recording medium, the method comprises controlling the print section so that the printing of the image is adjusted for each of the two sides depending on the adjustment value for each of the two sides, which is stored in the storing section.

In accordance with the fifth aspect of the present invention, an image forming method for image forming by controlling an image forming apparatus comprising:

a plurality of recording-media supplying trays for storing a recording medium for printing; and a storing section for storing an adjustment standard value group containing a plurality of adjustment standard values and an adjustment value group containing a plurality of adjustment values for changing the adjustment standard values of the adjustment standard value group so as to relate the adjustment standard value group and the adjustment value group to the recording-media supplying trays, respectively, the apparatus being capable of print adjustment for the recording medium supplied from the recording-media supplying tray related to the adjustment standard value group and the adjustment value group is performed based on the adjustment standard value group and adjustment value group for each side of the recording medium, the method comprises:

giving a name representing the adjustment value group to the adjustment value group to store the adjustment value group in the storing section; and reading out the adjustment value group based on the name.

In accordance with the sixth aspect of the present invention, an image forming method for image forming by controlling an image forming apparatus comprising:

a plurality of recording-media supplying trays for storing a recording medium for printing; and a storing section for storing an adjustment standard value group containing a plurality of adjustment standard values and an adjustment value group containing a plurality of adjustment values for changing the adjustment standard values of the adjustment standard value group so as to relate the adjustment standard value group and the adjustment value group to the recording-media supplying trays, respectively, the apparatus being capable of print adjustment for the recording medium supplied from the recording-media supplying tray related to the adjustment standard value group and the adjustment value group is performed based on the stored adjustment standard value group and adjustment value group for each of two sides of the recording medium, the method comprises, in a case that the predetermined adjustment value group is related to any one of the plurality of recording-media supplying tray and stored in the storing section, taking control so that information showing the case is displayed on a screen for inputting an instruction of a basic operation so as to relate the information to the recording-media supplying tray.

BRIEF DESCRIPTION OF THE DRAWINGS

The present invention will become more fully understood from the detailed description given hereinbelow and the accompanying drawings which are given by way of illustration only, and thus are not intended as a definition of the limits of the present invention, and wherein:

FIG. 2 is an illustration showing a configuration relating to data processing of an image forming apparatus to which the present invention is applied;

FIG. 3 is a drawing showing an example of print adjustment standard value group;

DETAILED DESCRIPTION OF THE PREFERRED EMBODIMENTS

Figure 1:
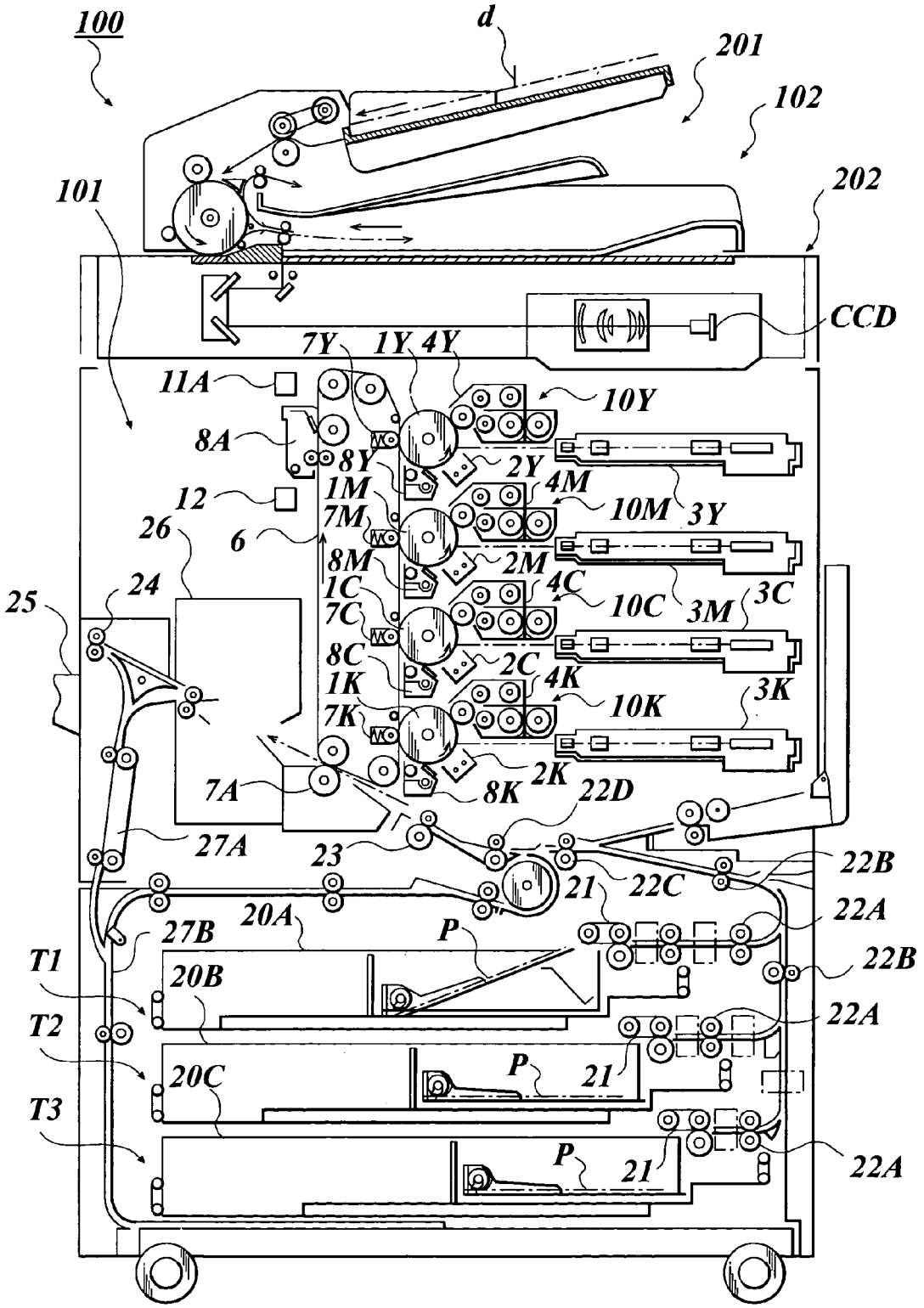
FIG. 1 is an illustration showing a configuration relating to print processing of an image forming apparatus to which the present invention is applied.

Hereinbelow, an embodiment of the present invention will be described based on the drawings.

A configuration relating to print processing of an image forming apparatus 100 will be described.

An image forming apparatus 100 comprises an image forming apparatus body 101 as a printing section and an image reader 102 at the upper portion of the image forming apparatus body 101. The image reader 102 comprises an automatic document feeding device 201 and a document image scanning exposure apparatus 202.

A document d stacked on an input tray of the automatic document feeder 201 is transported by transporting section. Images of one or both sides of the document are exposed by scanning of an optical system of the document image scanning exposure apparatus 202. Incident light reflecting the document images is read by a line image sensor CCD.

Analog image signals photoelectrically converted by the line image sensor CCD are processed by analog processing, A/D conversion, shading compensation, image compression processing, and the like in an image processing section 70 (see FIG. 2), and thus the signals are transformed into digital image data. The digital image data are outputted to image writing units 3Y, 3M, 3C, and 3K.

The automatic document feeder 201 comprises a reversing automatic document feeding unit (not shown). The automatic document feeder 201 sequentially reads contents of plenty of documents d (including both sides) transported from the input tray at a stretch. The contents are stored in a storage unit (electronic RDH). The electronic RDH is used when contents of plenty of documents are duplicated by duplication function, when plenty of documents d are transmitted by facsimile or the like.

The image forming apparatus 101 is a tandem type image forming apparatus where a plurality of photosensitive drums 1Y, 1M, 1C, 1K line up behind each other. Each of the photosensitive drums 1Y, 1M, 1C, and 1K is provided in each of image forming unit 10Y, 10M, 10C, and 10K for each color (yellow (Y) color, magenta (M) color, cyan (C) color, and block (BK) color). The image forming apparatus also comprises an intermediate transfer medium 6, a paper feeding section (not shown) including a paper re-feeding system (ADU system), and a fixing device 17 for fixing a toner image.

The image forming unit 10Y for forming a Y color image comprises: the photosensitive drum 1Y for forming a Y color toner image; and a charging section 2Y, an image writing unit 3Y, a developing device 4Y and a photosensitive drum cleaning unit 8Y disposed around the photosensitive drum 1Y.

The image forming unit 10M for forming a M color image comprises: the photosensitive drum 1M for forming a M color toner image; and a charging section 2M, an image writing unit 3M, a developing device 4M and a photosensitive drum cleaning unit 8M disposed around the photosensitive drum 1M.

The image forming unit 10C for forming a C color image comprises: the photosensitive drum 1C for forming a C color toner image; and a charging section 2C, an image writing unit 3C, a developing device 4C and a photosensitive drum cleaning unit 8C disposed around the photosensitive drum 1C.

The image forming unit 10K for forming a BK color image comprises: the photosensitive drum 1K for forming a BK color toner image; and a charging section 2K, an image writing unit 3K, a developing device 4K and a photosensitive drum cleaning unit 8K disposed around the photosensitive drum 1K.

The charging section 2Y and the image writing unit 3Y, the charging section 2M and the image writing unit 3M, the charging section 2C and the image writing unit 3C, and the charging section 2K and the image writing unit 3K form latent images of respective colors onto the photosensitive drums 1Y, 1M, 1C, and 1K, respectively.

Figure 4:
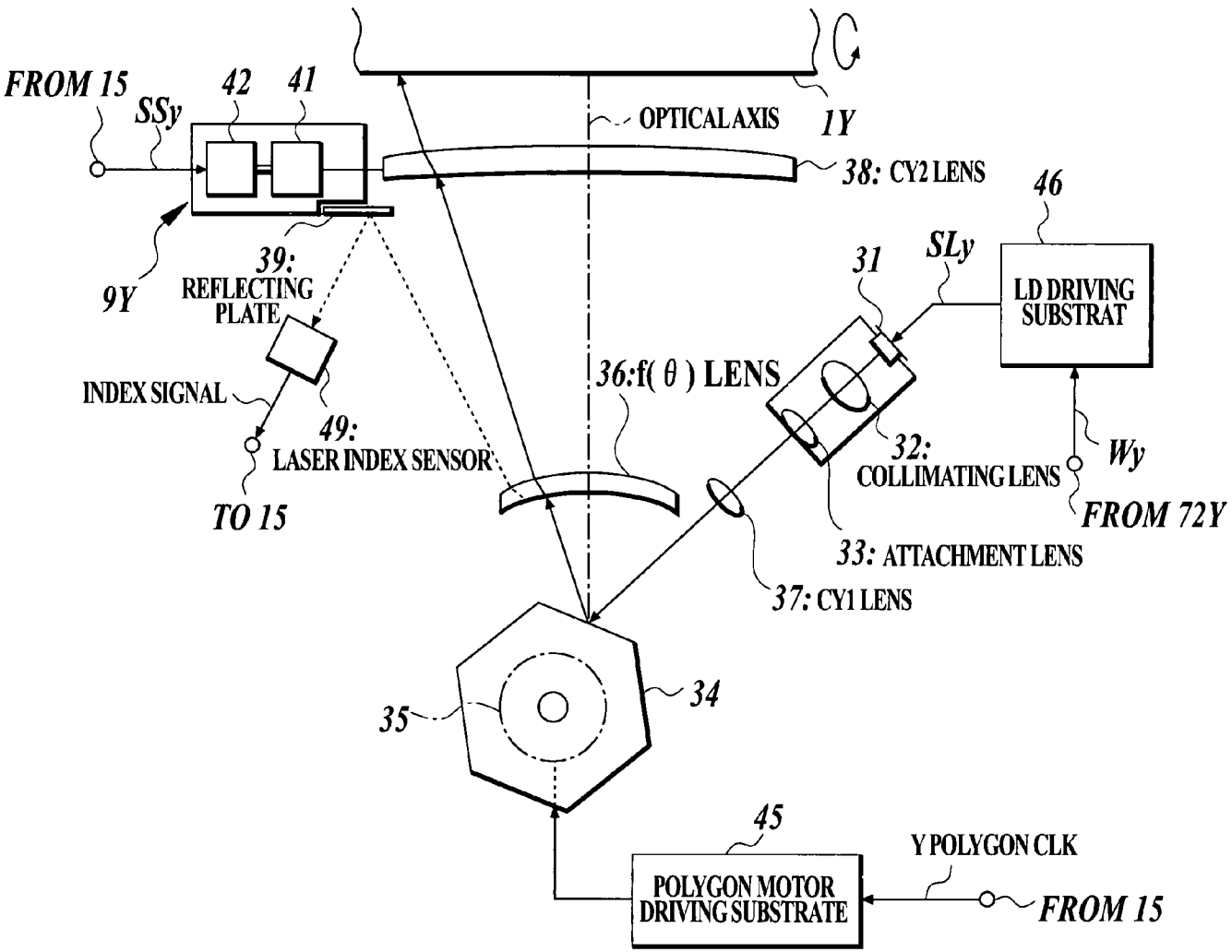
FIG. 4 is an illustration showing a configuration of the image writing unit shown in FIG. 1.

Each of the image forming units 3Y, 3M, 3C, and 3K performs skew adjustment based on each of skew adjustment signals SSy, SSm, and SSc outputted from a control section 15 (see FIG. 4). Each of the image writing units 3Y, 3M, 3C, and 3K forms each of Y color toner image, M color toner image, C color toner image, and BK color toner image on the intermediate transfer medium 6 based on each of write-data for Y color, write-data for M color, write-data for C color, and write-data for BK color outputted from the control section 15.

Development by the developing devices 4Y, 4M, 4C, and 4K is based on reversal development using a developing bias made by superimposing an AC voltage on a DC voltage of the same polarity as toner polarity (negative polarity in the present embodiment).

The intermediate transfer medium 6 has a belt supported in such a way that the belt is rotatably. Each toner image of Y color, M color, C color, and BK color formed on each of the photosensitive drum 1Y, 1M, 1C, and 1K is transferred onto the surface of the belt of the intermediate transfer medium 6.

A registration sensor 12 is provided at both of left and right sides of the intermediate transfer medium 6 upstream of an intermediate-transfer-medium-cleaning section 8A. At the time of color shift correction to be hereinafter described, the registration sensor 12 detects position of each color image (hereinafter, referred to as registration mark CR) including standard color (black in the present embodiment) for color shift correction formed on the intermediate transfer medium 6 by each of the image forming units 10Y, 10M, 10C, and 10K, and outputs a position detection signal S2 to the control section 15.

Hereinafter, the summary of image forming process of the above-described image forming apparatus 100 will be described.

Each color image formed by each of image forming units 10Y, 10M, 10C, and 10K is transferred sequentially on the surface of the belt of the rotating intermediate transfer medium 6 by each of primary transfer rollers 7Y, 7M, 7C, and 7K to which primary transfer bias with the polarity (positive polarity in the present embodiment) opposite to that of toner to be used is applied (primary transfer). And thus a color composite image (color image: color toner image) is formed. The color image is transferred from the intermediate transfer medium 6 onto a printer sheet P.

The printer sheet P contained in paper feed cassettes 20A, 20B, and 20C is fed by a delivery roller 21 and a paper feed roller 22A provided for each of paper feed cassettes 20A, 20B, and 20C. The printer sheet P is passed through transport rollers 22B, 22C, 22D, a registration roller 23 and the like to be transported to a secondary transfer roller 7A. The color image is transferred onto one side (front or back side) of the printer sheet P (secondary transfer).

Each of the paper feed cassettes 20A, 20B, and 20C is set in each of recording-media supplying trays T1, T2, and T3 capable to be pulled out/pushed back. An operator pulls out the recording-media supplying tray T1 or the like to reload the printer sheet P in the paper feed cassette 20A or the like, and then push the recording-media supplying tray T1 or the like pulled out back to the machine body.

Printer sheets P of a same paper type (material, basis weight, size, thickness, coated/uncoated and the like) are stored in each of the paper feed cassttes 20A, 20B and 20C.

The printer sheet P onto which the toner image is transferred is processed for fixing by the fixing device 17. Then the printer sheet is sandwiched and held by an eject roller 24 and put on an ejected-recording-media supplying tray 25 on the outside of the body. Transfer residual toner remaining on the peripheral surfaces of the photosensitive drums 1Y, 1M, 1C and 1K is cleaned by the photosensitive drum cleaning units 8Y, 8M, 8C and 8K to make the transition to the next image forming cycle.

In both side image forming, the printer sheet P having one side (front side) on which an image is formed is ejected from the fixing device 17, and is diverted from a sheet ejecting path by a diverting section 26, passes through a paper circulating path 27A located at a lower position, and then the printer sheet P is reversed by a reverse feeding path 27B. Then the printer sheet P passes through a paper re-feeding path and converge at the transport roller 22D.

The reverse fed printer sheet P is fed through a registration roller 23 to a secondary transfer roller 7A and a color image (color toner image) is transferred onto the other side (back side) of the printer sheet P. the printer sheet P onto which the color image has been transferred is processed for fixing by the fixing device 17 and the printer sheet is sandwiched and held by an eject roller 24 and put on an ejected-recording-media supplying tray 25 on the outside of the body. After the color image is transferred onto the printer sheet P by the secondary transfer roller 7A, the intermediate transfer medium 6 from which the printer sheet P has been separated is cleared of residual toner by an intermediate transfer medium cleaning unit 8A.

Next, a configuration relating to data processing of the image forming apparatus 100 will be described with reference to FIGS. 2, 3 and 4.

As shown in FIG. 2, the image forming apparatus 100 comprises, in addition to each component relating to print processing shown in FIG. 1 as described above, correcting units 5Y, 5M and 5C, a registration sensor 12, nonvolatile memory 14, a control section 15, an operating section 16, a display section 18, laser index sensor 49, image processing section 70.

The correcting units 5Y, 5M and 5C adjust gradients of image writing units 3Y, 3M and 3C in the horizontal direction depending on position correcting signals Sc, Sy, Sm and Sc outputted from the control section 15, respectively.

The registration sensor 12 is a CCD sensor, a reflection type photosensor or the like (any not shown). The registration sensor 12 detects passing timing of a registration mark CR (toner image) for color shift correction mode formed on the intermediate transfer medium 6 in the after-described auto color shift correction mode. Then the registration sensor 12 outputs a result of the detection as a position detecting signal S2 to the control section 15.

The nonvolatile memory 14 as a memory unit stores various data generated in execution of various programs executed by the control section 15. In particular, a print adjustment standard value group as an adjustment standard value group, a print adjustment offset value group as an adjustment value group associated with a print adjustment name, a print adjustment offset value group as an adjustment value group which is set for each recording-media supplying trays T1 to T3 at present (or, a corresponding print adjustment name) and the like.

The above-described adjustment values are set for each of two sides of a recording medium to specify magnification, print position, fixing temperature and the like. An adjustment value group contains a plurality of adjustment values. The adjustment value group comprises an adjustment value for each print adjustment item. Print adjustment items include, for example, printer lead edge timing adjustment (timing of turning on registration roller), printer registration loop adjustment (timing of turning off paper feed roller), printer shift adjustment (main scan writing timing), printer vertical zoom adjustment (transfer belt speed), printer horizontal zoom adjustment (frequency of pixel clock), a fixing temperature, a transfer/separating current value and the like, but are not limited thereto, and various setting is possible. For example, when there are five print adjustment items, preferably the five print adjustment items are set for each of two sides of a printer sheet. In this case, an adjustment value group comprises a total of 10 print adjustment items of two sides of a printer sheet.

The above-described adjustment value may be a control value itself, or in the following case that an adjustment standard value is set, the adjustment value may be a value for changing (adding, subtracting and the like) the adjustment standard value. Because the adjustment value can respond to fine adjustment, it is preferable that the adjustment value is inputted by a user. In view of ease of input in case that a user inputting the adjustment value, the adjustment value is more preferably a value for changing the adjustment standard value than a control value itself.

An adjustment standard value is a threshold which is set depending on the most general paper type with respect to magnification, print position, fixing temperature and the like, as is the case with the above-described adjustment value. Preferably the adjustment standard value is set by a service person or by default before shipment. In particular, it is preferable that the adjustment standard value is set by a service person in installation or the like in that an installation circumstance can be considered more.

Preferably, the above-described adjustment standard value is set for each of two sides of a recording medium. While preferably the adjustment standard value is set separately for each recording-media supplying tray, the adjustment standard value may be commonly set for all recording-media supplying trays. An adjustment standard value group contains a plurality of adjustment standard values. The adjustment standard value group comprises an adjustment standard value for each of a plurality of print adjustment items. The print adjustment items include the same as the above-described adjustment standard value.

In FIG. 3, an example of a print adjustment standard value group stored in the nonvolatile memory 14 us shown in tabular format. Here, fixing temperatures of each of two sides of printer sheets in print obtained from paper basis weight as adjustment standard values are shown as for three paper types of "normal paper", "recycled paper" and "coated paper".

For example, as for a print sheet of which the paper type is "normal paper" and the paper basis weight is in the range of "1 to 50 g/m$^2$", a fixing temperature of the front side is set to 200° C. and a fixing temperature of the back side is set to 200° C. Similarly, as for a print sheet of which the paper type is "recycled paper" and the paper basis weight is in the range of "101 to 150 g/m$^2$", a fixing temperature of the front side is set to 195° C. and a fixing temperature of the back side is set to 190° C.

In the case that a print adjustment value due to the above-described print adjustment standard value group is changed by a fine adjustment or the like and in case which cannot be treated with a print adjustment value due to the print adjustment standard value group, the most suitable print adjustment is possible also for paper types which cannot be treated enough by only the print adjustment standard value group, by changing the print adjustment value by use of a print adjustment offset value group for each adjustment standard value which the print adjustment standard value group has. A premium quality image printing (including duplex printing) can be performed easily independent of a paper type.

Print adjustment items are not limited to the above-described fixing temperature in printing, and various setting is possible. For example, printer lead edge timing adjustment (timing of turning on registration roller), printer registration loop adjustment (timing of turning off paper feed roller), printer shift adjustment (main scan writing timing), printer vertical zoom adjustment (transfer belt speed), printer horizontal zoom adjustment (frequency of pixel clock), a transfer/separating current value and the like.

The control section 15 as a control section controls the image forming apparatus 100 as a whole by execution of various programs stored in an embedded memory (or by a hardware).

The control section 15 controls the image forming unit 10Y, 10M, 10C and 10K to form toner images of Y color, M color, C color and BK color onto the intermediate transfer medium 6 based on writing data Wy for Y color, writing data Wm for M color, writing data Wc for C color, and writing data Wk for BK color outputte from an image processing section 70.

The control section 15 outputs an image processing control signal S4 to the image processing circuit 71 to control operation of the image processing circuit 71.

The control section 15 outputs a write selecting signal S5 to each of a Y-signal switching unit 72Y, an M-signal switching unit 72M, a C-signal switching unit 72C and a K-signal switching unit 72K to control them.

The control section 15 output position correcting signals Sy, Sm and Sc to correcting units 5Y, 5M and 5C to cause them to adjust a gradient of image writing unit 3Y, 3M and 3C in the horizontal direction, respectively.

The control section 15 outputs skew adjustment signals SSy, SSm and SSc to the image writing unit 3Y, 3M and 3C to perform skew adjustment of image writing unit 3Y, 3M and 3C, respectively.

The control section 15 generates an output starting timing of data for printing based on an index signal for each color inputted from a laser index sensor 49.

The output starting timing is a timing when the Y-signal switching unit 72Y, the M-signal switching unit 72M, the C-signal switching unit 72C and the K-signal switching unit 72K output the writing data Wy, Wm, Wc and Wk to the image writing unit 3Y, 3M, 3C and 3K, respectively.

When an instruction of change of a print magnification (for example, the print magnification for the back side in duplex printing) is inputted through the operating section 16, the control section 15 set a process speed or the rotational speed of a polygon mirror 34 based on the changed print magnification and LUT (Look Up Table) for magnification correction and performs printing based on the changed print magnification.

The LUT for magnification correction is data showing correspondence of the printer magnification to the process speed or the rotational speed of the polygon mirror 34, and is stored in the nonvolatile memory 14 in advance.

The control section 15 controls the process speed and the rotational speed of the polygon mirror 34, and additionally output timing of print data based on an apparatus-specific print adjustment standard value group for each of recording-media supplying trays T1 to T3.

When a print adjustment offset value group is inputted for each of recording-media supplying trays T1 to T3 and for each of two sides of a printer sheet through the operating section 16, the control section 15 stores the print adjustment offset value group (or a print adjustment name representing the print adjustment offset value group) in the nonvolatile memory 14 for each of recording-media supplying trays T1 to T3.

Figure 5:
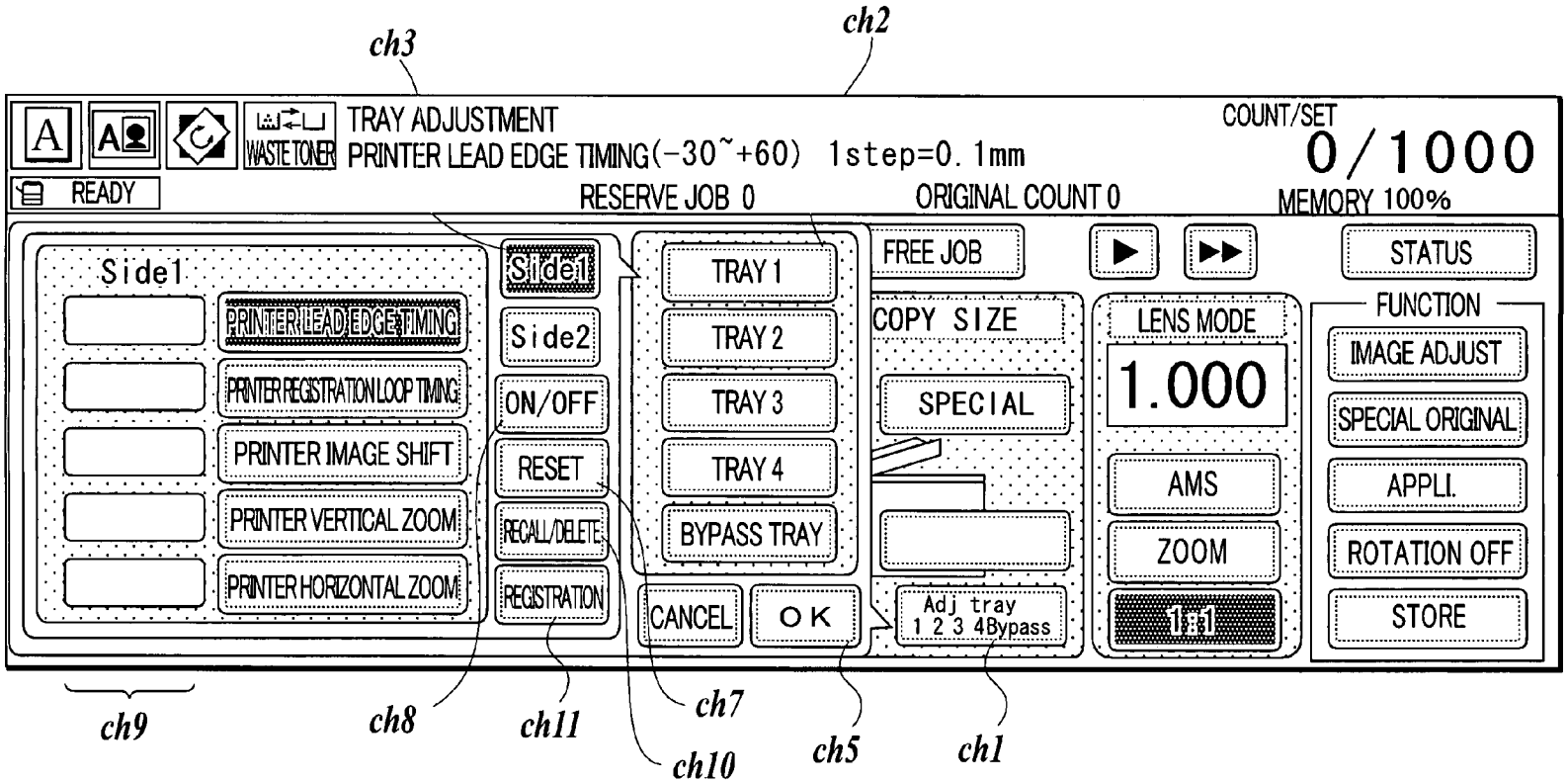
FIG. 5 is an illustration showing an example of an entry screen of a print adjustment offset value group.

An entry screen of a print adjustment offset value group is shown in FIG. 5. The entry screen shown in FIG. 5 is a screen displayed by touching (pushing down) an input button (input by a touch panel of the operating section 16) shown by reference mark Ch1 on a basic operation screen shown in FIG. 6 or 13. The basic operation screen is a screen for setting of a print sheet or a recording-media supplying tray. In FIG. 5, there is displayed an entry screen of a print adjustment offset value group (here, 5 items of adjustment values of "printer lead edge timing", "printer registration loop timing", "printer shift", "printer vertical zoom" and "printer horizontal zoom") for the front side (see the display place of "SIDE 1" of shown by reference mark Ch3) of the recording-media supplying tray T1 (see the display place of "TRAY 1" shown by reference mark Ch2). In FIG. 5, the recording-media supplying tray T1 is represented by "TRAY 1", the recording-media supplying tray T2 is represented by "TRAY 2" and the recording-media supplying tray T3 is represented by "TRAY 3".

Figure 6:
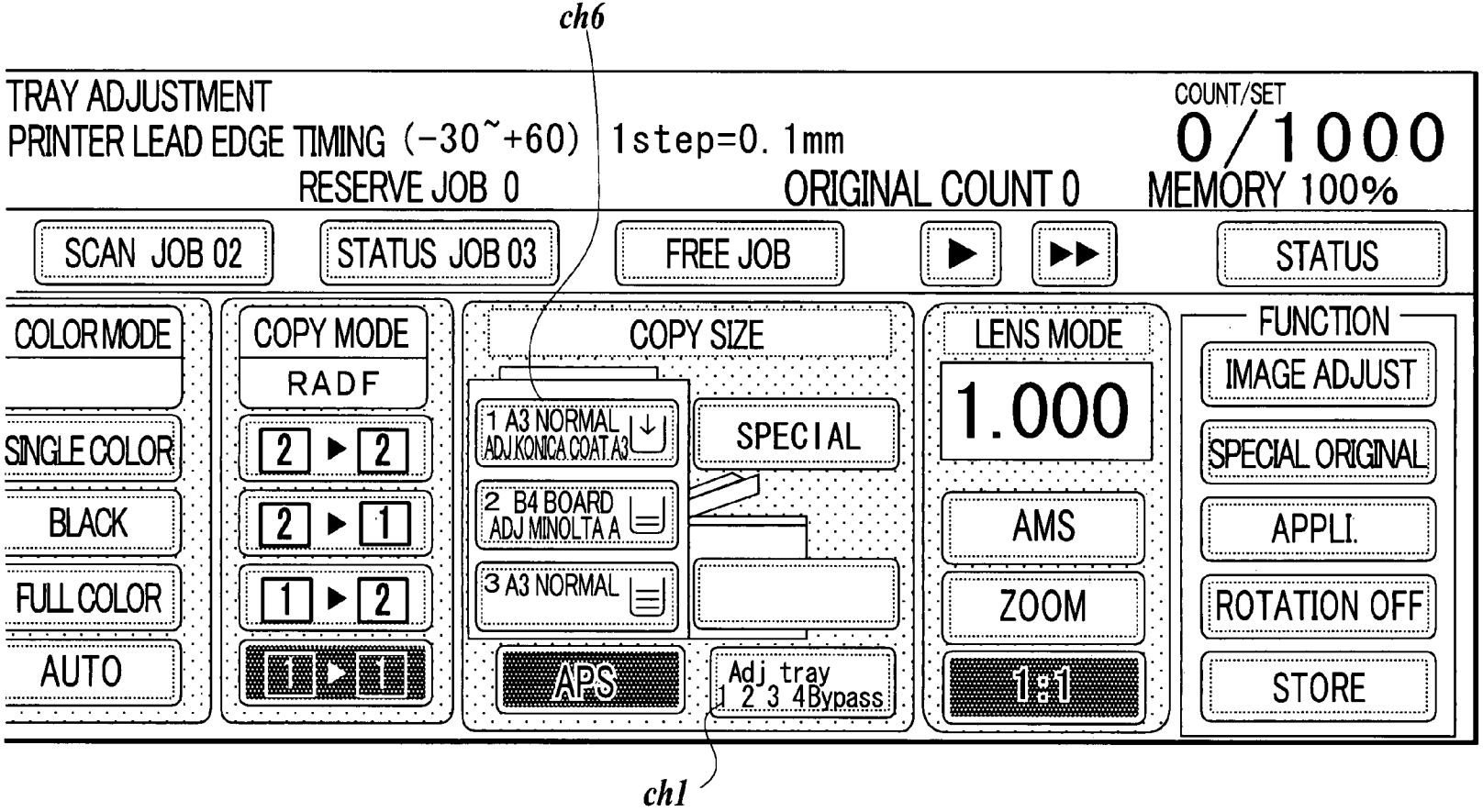
FIG. 6 is an illustration showing an example of a basic operation screen.
Figure 13:
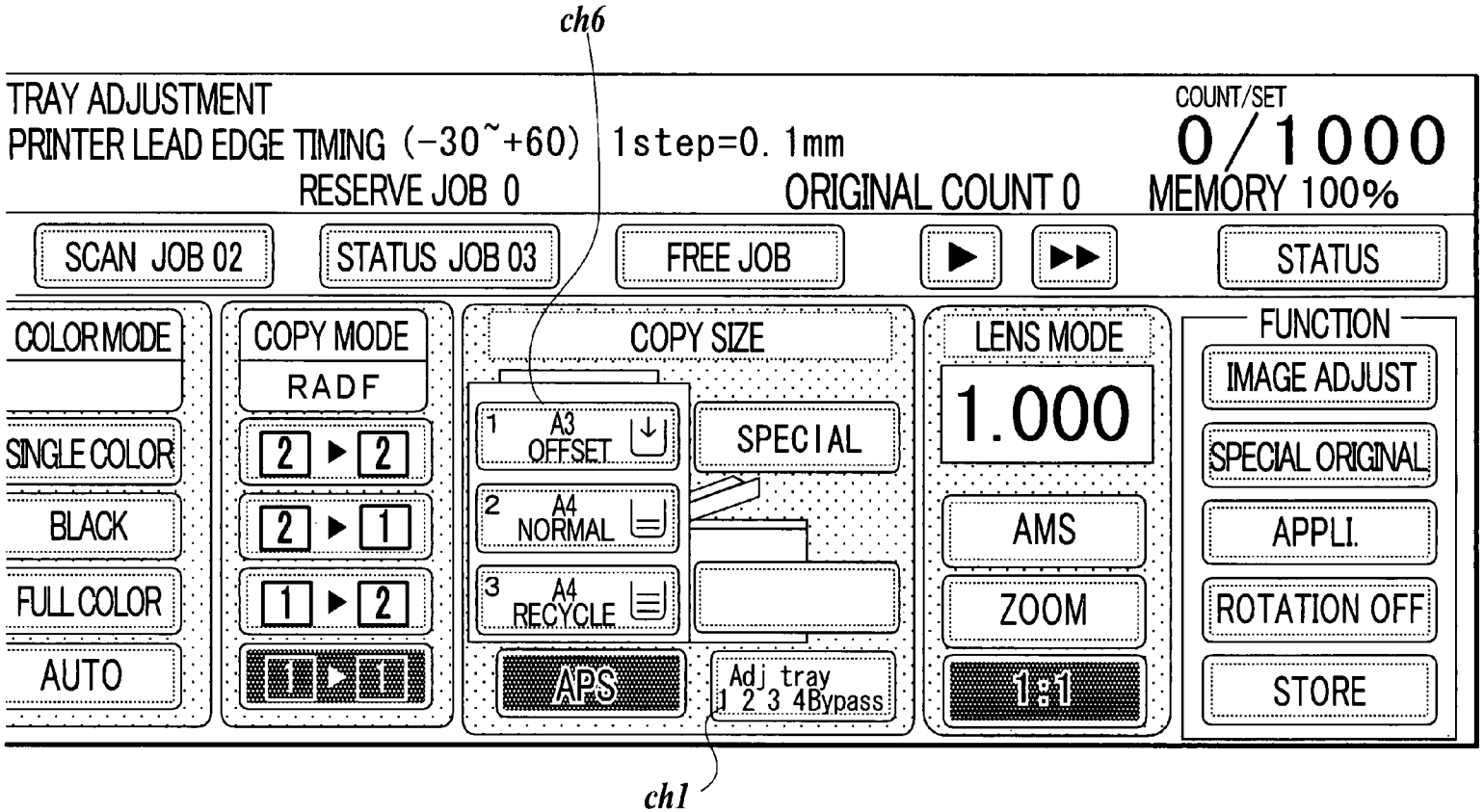
FIG. 13 is an illustration showing an example of a basic operation screen.

After a user inputs a print adjustment offset value group to respective spaces (five spaces) shown by reference mark Ch9 for each of two sides of a printer sheet of the recording-media supplying tray T1, when an "OK" button shown by reference mark Ch5 is touched, the inputted print adjustment offset value group is stored in the nonvolatile memory 14 by the control section 15 and the screen returns to the basic operation screen shown in FIG. 6 or 13. Thereby registration of the print adjustment offset value group for each recording-media supplying tray and for each of two sides of a print sheet is completed.

In the present embodiment, a print adjustment offset value inputted by a user is a value as shown in FIG. 3 which instructs adjustment of a print adjustment standard value for each adjustment item a print adjustment standard value group has, or the like. The form of the instruction is not limited specifically. For example, the form may be those which instruct addition or subtract of a predetermined value, such as "+5" or "−5", to the print adjustment standard value, and also may be a value instructing such a predetermined proportion as makes the print adjustment standard value a value of "95%".

When a "RESET" button shown by reference mark Ch7 is touched, all of the print adjustment offset value group for any one recording-media supplying tray and side of the recording-media supplying trays T1 to T3 which is under setting at present are cleared (that is, print adjustment offset values becomes zero) by the control section 15 collectively. In this case, the print adjustment offset value group stored in the nonvolatile memory 14 by the control section 15 is deleted collectively and only a print adjustment standard value group is valid for the recording-media supplying tray.

When an "ON/OFF" button shown by reference mark Ch8 is touched once, a flag (hereinafter, referred to as an OFF flag) meaning that a print adjustment offset value group is not used for any one recording-media supplying tray and side of the recording-media supplying trays T1 to T3 which is under setting at present but a print adjustment standard value group is used, is stored in the nonvolatile memory 14 by the control section 15. When the "ON/OFF" button is touched once more, a flag (hereinafter, referred to as an ON flag) meaning that a print adjustment offset value group is used for the recording-media supplying tray is stored in the nonvolatile memory 14 by the control section 15. The control section 15 determines whether to use the print adjustment standard value group or the print adjustment offset value group, with reference to the flag for each of the recording-media supplying trays T1 to T3.

In the case that a mode for a service person to input a print adjustment standard value group is set, even though a print adjustment offset value group has been registered, the control section 15 does not use the print adjustment offset value group. That is, in this case, the control section 15 stores the above-described OFF flag in the nonvolatile memory 14.

The control section 15 performs each processing shown in FIGS. 9 to 12 by executing a program stored in the embedded memory in advance.

The operating section 16 as an instructing unit comprises a keyboard or a pointing device, such as a mouse or a touch panel (attached to an LCD (Liquid Crystal Display) of a display section 18), and outputs various signals to the control section 15.

The display section 18 comprises a displaying device such as an LCD, and displays various display data inputted from the control section 15. In particular, the display section 18 displays each screen shown in FIG. 5 to 8 and 13.

A laser index sensor 49 detects a beam light irradiated from each of the image writing units 3Y, 3M, 3C and 3K and outputs an index signal to the control section 15.

An image processing section 70 comprises an image processing circuit 71, a Y-signal switching unit 72Y, an M-signal switching unit 72M, a C-signal switching unit 72C and a K-signal switching unit 72K.

The image processing circuit 71 performs color conversion of R, G and B signals relating to R, G and B color components of a color image read by the image reader 102 based on an image processing control signal S4, and outputs image data Dy, Dm, Dc and Dk to the Y-signal switching unit 72Y, the M-signal switching unit 72M, the C-signal switching unit 72C and the K-signal switching unit 72K, respectively.

For Y, M, C and K signals inputted from such an external apparatus as a printer, after screen processing of each of these signals based on the image processing control signal S4, the image processing circuit 71 outputs image data Dy', Dm', Dc' and Dk' to the Y-signal switching unit 72Y, the M-signal switching unit 72M, the C-signal switching unit 72C and the K-signal switching unit 72K, respectively.

The Y-signal switching unit 72Y, the M-signal switching unit 72M, the C-signal switching unit 72C and the K-signal switching unit 72K select either of image data Dy or image data Dy', either of image data Dm or image data Dm', either of image data Dc or image data Dc' and either of image data Dk or image data Dk' and output them to the image writing units 3Y, 3M, 3C and 3K, respectively.

Next, a configuration of the image writing unit 3Y will be described with reference to FIG. 4. Note that the description here is no difference in the case of image writing units 3M, 3C and 3K for other colors than Y color (that is, M color, C color and BK color).

As shown in FIG. 4, the image writing unit 3Y comprises a laser diode light source 31, a collimating lens 32, an attachment lens 33, a polygon mirror 34, a polygon motor 35, a f(θ) lens 36, a CY1 lens 37 for imaging on the mirror surface, a CY2 lens 38 for imaging on the drum surface, a reflecting plate 39, a polygon motor driving substrate 45 and an LD (Laser Diode) driving substrate 46.

The LD driving substrate 46 performs PWM (Pulse Width Modulation) on a writing data Wy, and outputs a laser driving signal SLy having a predetermined pulse width after PWM to the laser diode light source 31.

The laser diode light source 31 outputs laser beam for Y color to the collimating lens 32 based on the laser driving signal SLy. The laser beam for Y color outputted from the laser diode light source 31 is formed into a predetermined beam light by the collimating lens 32, the attachment lens 33 and the CY1 lens 37 for imaging on the mirror surface.

The polygon mirror 34 deflects the laser beam in the main scan direction after being formed by the collimating lens 32 and the like. The polygon motor driving substrate 45 outputs a driving signal for rotating the polygon mirror 34 to the polygon motor 35 on the basis of Y polygon CLK outputted from the control section 15. The polygon motor 35 rotates the polygon mirror 34 on the basis of the driving signal inputted from the polygon motor driving substrate 45.

The f(θ) lens 36 and the CY2 lens 38 for imaging on the drum surface focus the beam light deflected by the polygon mirror 34 onto the surface of the photosensitive drum 1Y. Thereby an electrostatic latent image is formed on the surface of the photosensitive drum 1Y.

A skew adjustment unit 9Y comprises an adjusting gear 41 and an adjusting motor 42 driving the adjusting gear 41. The adjusting gear 41 is joined with the CY2 lens 38 for imaging on the drum surface. The adjusting motor 42 drives the adjusting gear 41 depending on a skew adjustment signal SSy to adjust a gradient of the CY2 lens 38 for imaging on the drum surface joined to the adjusting gear 41 in the vertical direction. Thereby the skew adjustment is performed.

In the case that a part of the beam light reflected by the polygon mirror 34 is reflected by the reflecting plate 39 to enter the laser index sensor 49, the laser index sensor 49 outputs an index signal to the control section 15.

Next, operation of the image forming apparatus 100 will be described with separation into examples 1 and 2.

EXAMPLE 1

The image forming apparatus 100 of the example 1 will be described with reference to FIGS. 5 to 11. Operation in cases that a print adjustment offset value group is named a name representing the print adjustment offset value group and stored in the nonvolatile memory 14 to control the print adjustment offset value group, is shown in the example 1.

The example 1 is on condition that a print adjustment offset value group is set (registered) in advance for each of the recording-media supplying tray and for each of two sides of a printer sheet, and the form of the registration is is those which is registered in the form where a print adjustment name corresponding to the print adjustment offset value group is given to the print adjustment offset value group.

Figure 7:
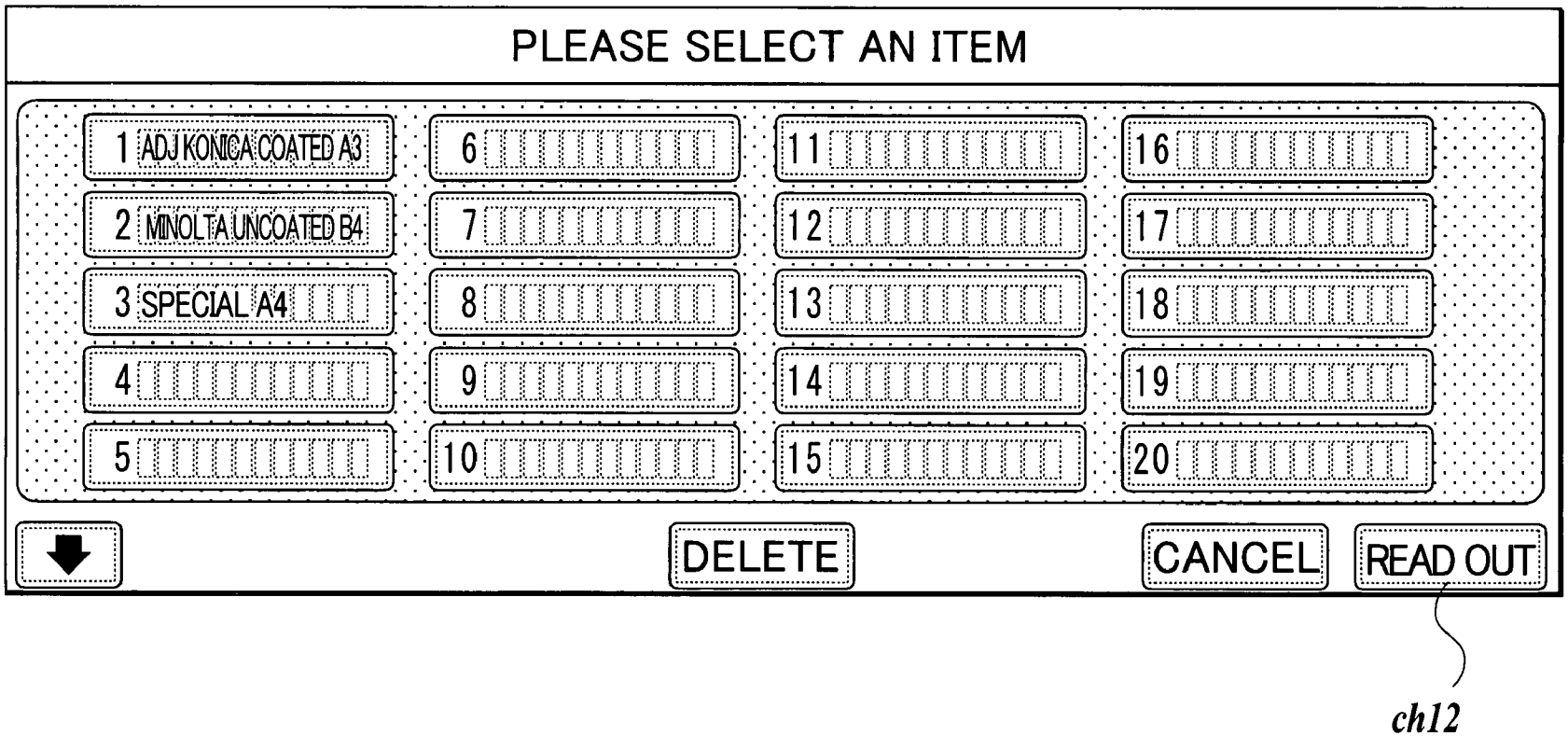
FIG. 7 is an illustration showing an example of a display screen of a print adjustment name list.

When the "TRAY 1" button shown by the reference mark Ch2 is touched and the recording-media supplying tray is selected, in case that a "RECALL/DELETE" button shown by the reference mark Ch10 is touched, a list of print adjustment names showing a list of print adjustment offset value groups (represented by print adjustment names) stored in the nonvolatile memory 14 in advance is displayed to the display section 18 by the control section 15 as shown in FIG. 7 (see step S1).

In the list of print adjustment names shown in FIG. 7, three kinds of print adjustment names (that is, names representing print adjustment names) of "KONICA COATED A3", "MINOLTA UNCOATED B4", "SPECIAL PAPER A4" are displayed.

When subsequently the display place of any print adjustment name (for example, "KONICA COATED A3") is touched (see step S2; YES), the display place is highlighted. Additionally, when a "READ" button shown by reference mark Ch12 is touched on a display condition like this, a print adjustment offset value group represented by the highlighted print adjustment name is read out from the nonvolatile memory 14 by the control section 15 (step S3). At the time, an offset value of the read-out print adjustment offset value group for each adjustment item is displayed in each space shown by reference mark Ch9 automatically by the control section 15 (step S4).

When an "OK" button shown by reference mark Ch5 is touched on this condition, the print adjustment name "KONICA COATED A3" is displayed on the basic operation screen shown in FIG. 6 by the control section 15, for example, as shown by reference mark Ch6. the print adjustment offset value group is stored in the nonvolatile memory 14 as a print adjustment offset value group for the recording-media supplying tray T1. Then setting (registration) of a print adjustment offset value group for the recording-media supplying tray T1 is finished.

Furthermore, after the above-described print adjustment offset value group is read out (step S10), when at least one offset value of respective values (are offset values of a print adjustment offset value group for respective print adjustment items and are displayed for respective sides of a printer sheet) shown by reference mark Ch9 is changed (step S11; YES), the display of the print adjustment name "KONICA COATED A3" is deleted from the basic operation screen shown in FIG. 6 (and in this case, "KONICA COATED A3"

representing a print adjustment name of "ADJ KONICA COATED A3" is deleted to switch to displaying only "ADJ")(step S12).

Figure 8:
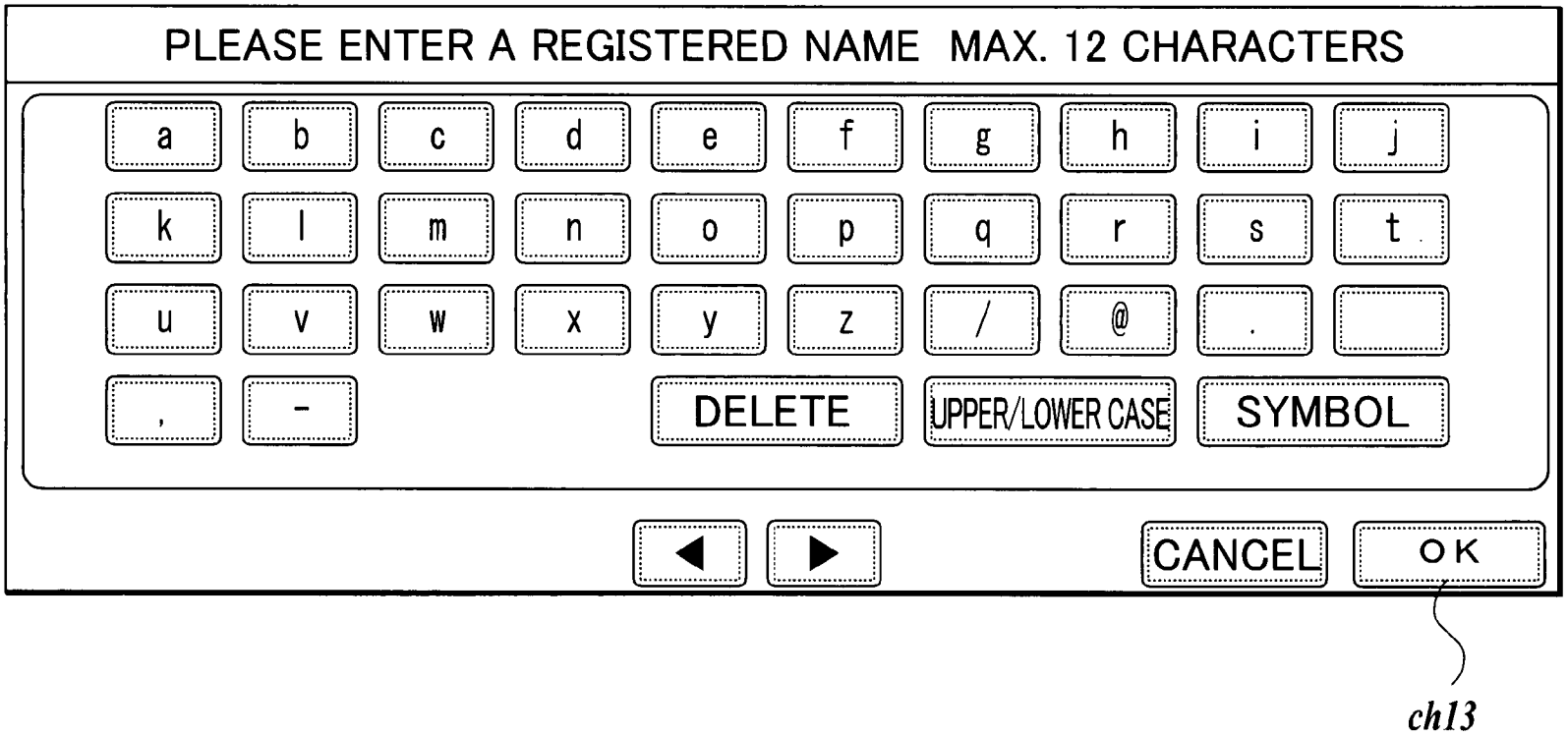
FIG. 8 is an illustration showing an example of a display screen of a keyboard for inputting a print adjustment name.
Figure 9:
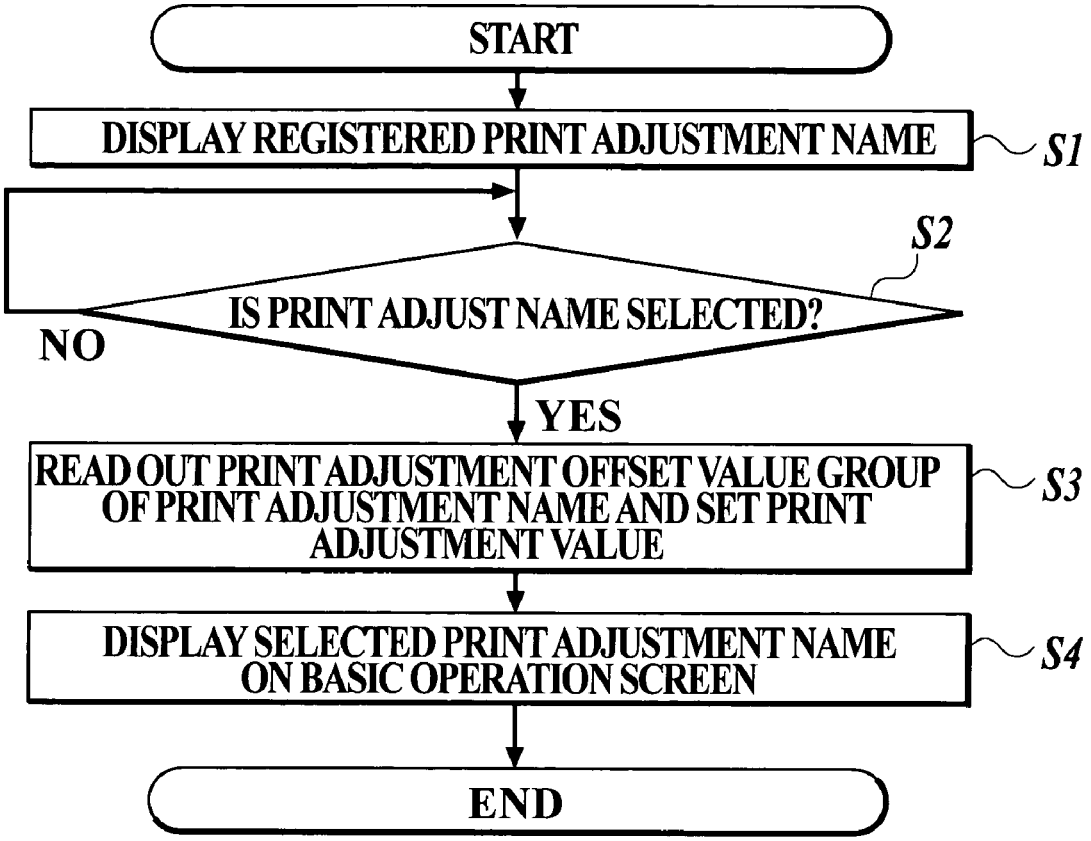
FIG. 9 is a flowchart illustrating a print adjustment processing to which the present invention is applied.
Figure 10:
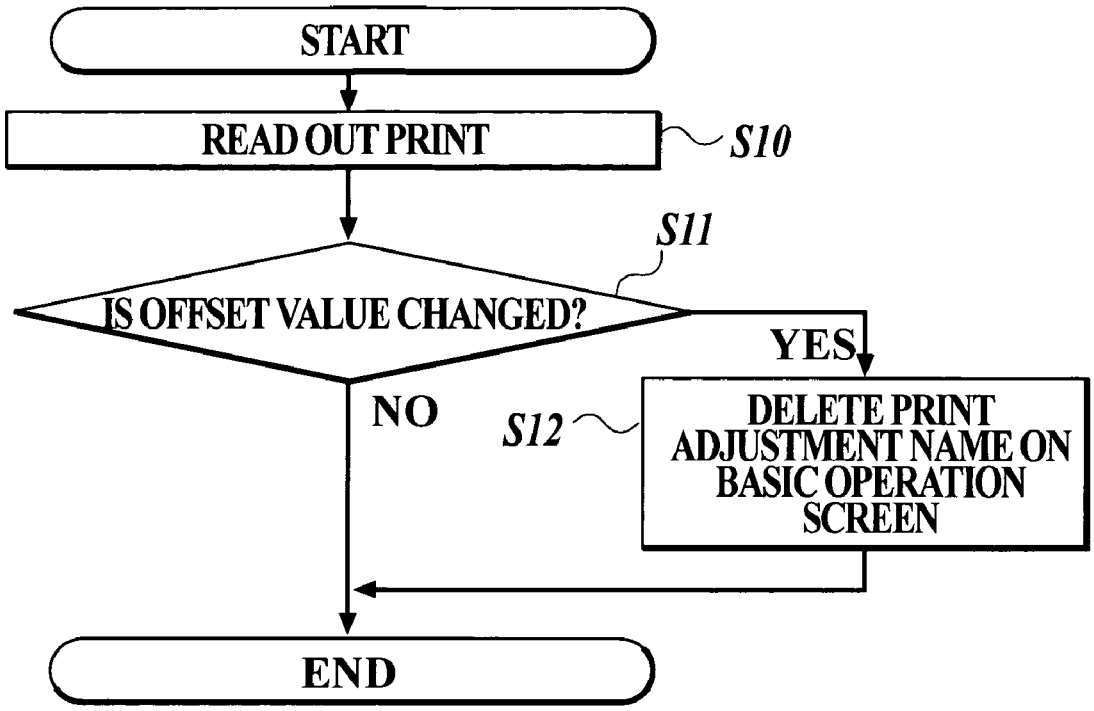
FIG. 10 is a flowchart illustrating a print adjustment processing to which the present invention is applied.
Figure 11:
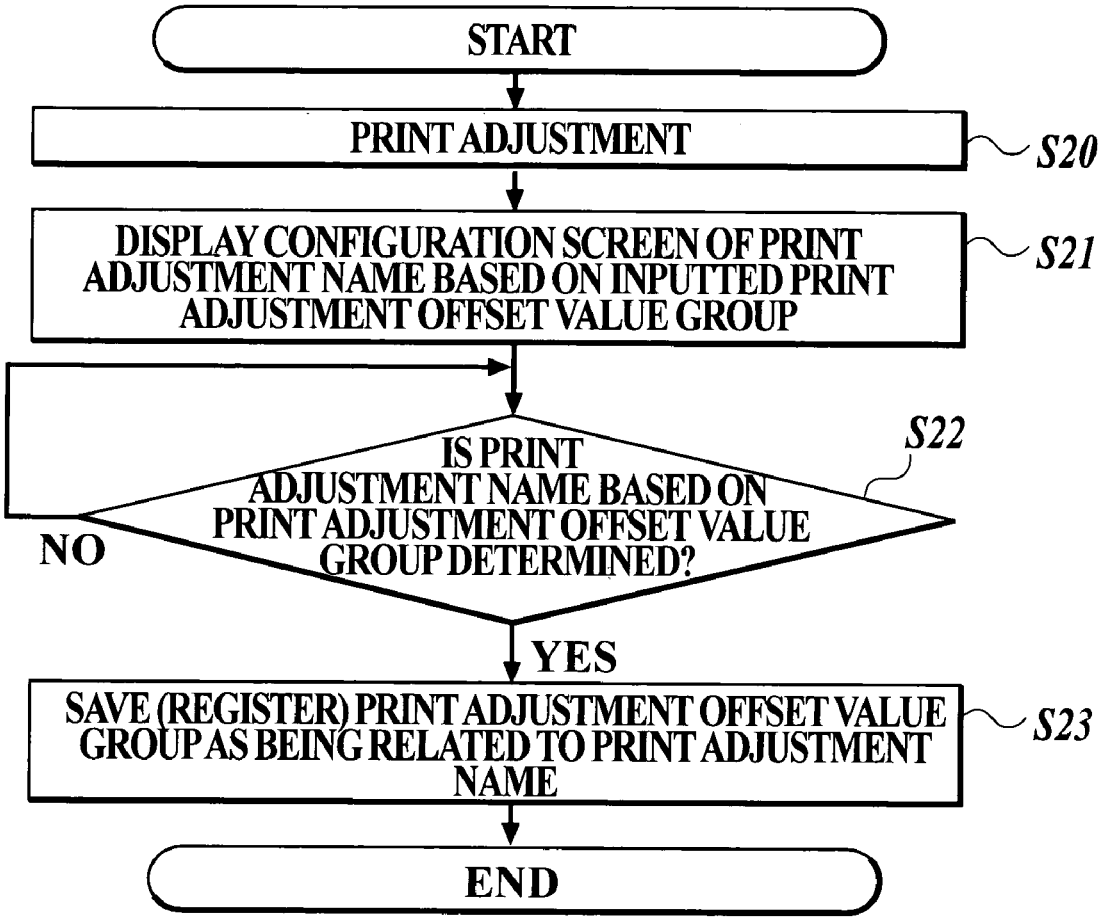
FIG. 11 is a flowchart illustrating a print adjustment processing to which the present invention is applied.

When a "REGISTER" button shown by reference mark Ch11 is touched on such a display condition (step S20), a print adjustment name entry screen shown in FIG. 8 is displayed by the control section 15 (step S21), and it goes to waiting for input of a print adjustment name for the print adjustment offset value group after the change.

When a print adjustment name (for example, "KONICA COATED A3" again) is subsequently inputted through the print adjustment name entry screen shown in FIG. 8 and a "OK" button shown by reference mark Ch13 is touched (step S22; YES), the changed print adjustment offset value group is associated with the inputted print adjustment name and stored (registered) in the nonvolatile memory 14 by the control section 15 (step S23). At this time, the print adjustment name "KONICA COATED A3" is displayed on the basic operation screen shown in FIG. 6. For example, in FIG. 6, "KONICA COATED A3" representing the print adjustment name set for the recording-media supplying tray T1 is displayed in the display place shown by reference mark Ch6.

Accordingly, a print adjustment offset value group for a print adjustment standard value group is given a name and stored. The print adjustment offset value group is managed with the name. Therefore a plurality of groups of print adjustment offset values corresponding to various paper types become available easily and quickly by only designation of a name, and thus it is possible to improve operationality. Thereby it becomes possible to make detailed print adjustment using a print adjustment offset value group with simple operation and thus possible to easily obtain high quality images.

Furthermore it is possible that various print adjustments are performed effectively because a print adjustment offset value group is collectively set for each recording-media supplying tray.

Furthermore because a print adjustment offset value group is read out by specifying its print adjustment name, management of the print adjustment offset value group becomes very easy when what represents a paper type or the like is used for the name, which includes that a user can confirm the content of a print adjustment offset value group easily and assignment of a print adjustment offset value group is very easy.

Furthermore what print adjustment offset value group is set and for which recording-media supplying tray the print adjustment offset value group is set at present can be confirmed easily and quickly because the print adjustment name of the print adjustment offset value group is displayed on the basic operation screen.

Furthermore a print adjustment value does not have to be reset for each print processing, and it is possible to avoid such an unexpected situation as setting failure which may be caused by frequent prind adjustment.

Furthermore in case of using again a paper type of a print sheet used before, conveniently the print adjustment value for the paper type does not have to be set anew.

EXAMPLE 2

Figure 12:
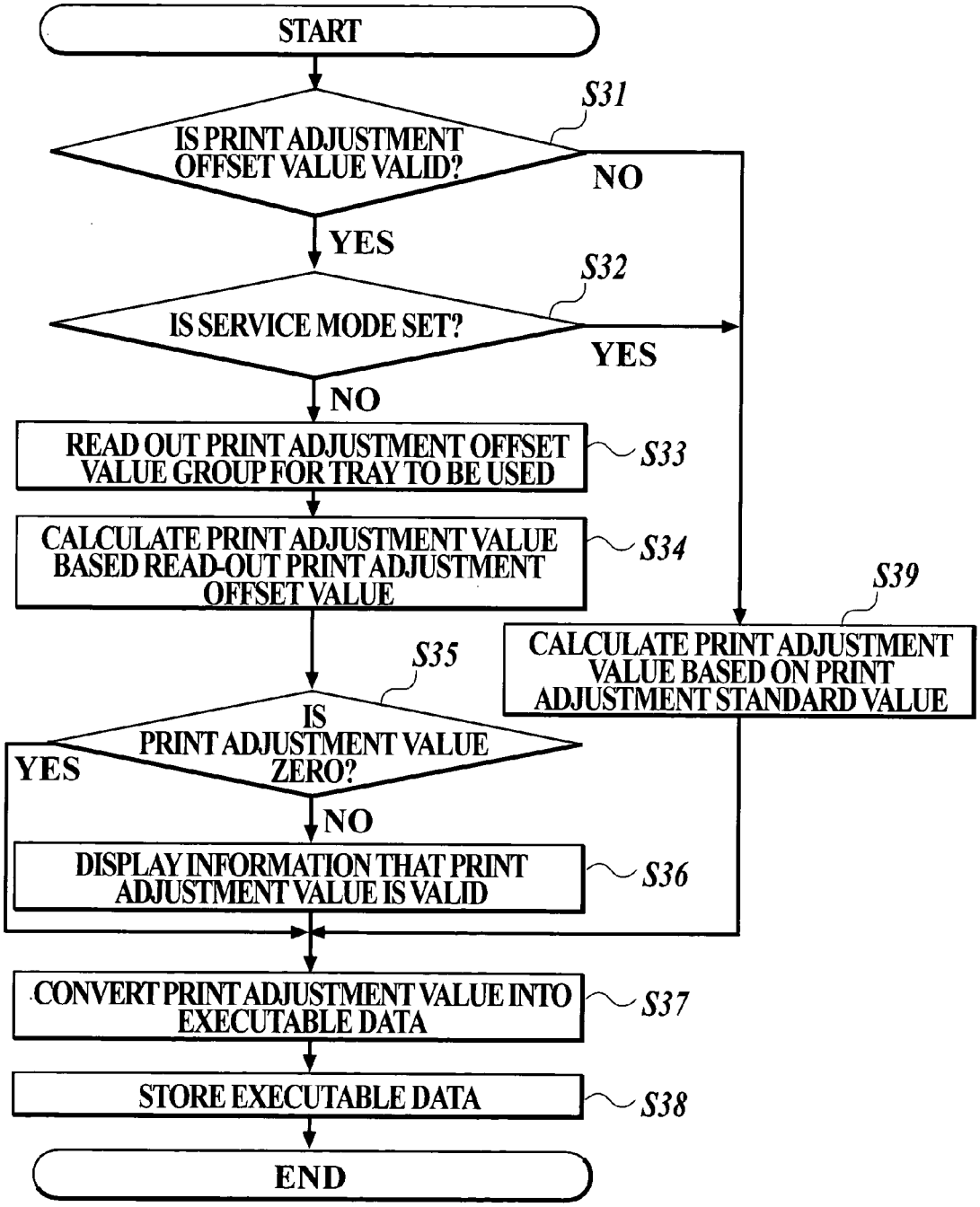
FIG. 12 is a flowchart illustrating a print adjustment processing to which the present invention is applied.

Next, operation of the image forming apparatus 100 of the example 2 will be described with reference to FIGS. 12 and 13. The example 2 shows the operation in inputting a print adjustment offset value group with preservation (without deletion) of a stored print adjustment standard value group which is associated with each of the recording-media supplying trays T1 to T3 and each of two sides of a print sheet.

The example 1 is on condition that a print adjustment offset value group is registered in advance for each of the recording-media supplying tray and for each of two sides of a printer sheet. A form of registration of a print adjustment offset value group is not especially considered. A print adjustment offset value group may be registered in the form where a print adjustment name representing the print adjustment name is given or may be registered in another form.

The control section 15 determines whether a print adjustment offset value group is valid or not for the recording-media supplying trays T1 to T3 to be used, that is, which is stored in the nonvolatile memory 14, an ON flag or an OFF flag (step S31) for each of the recording-media supplying trays T1 to T3.

In case that the print adjustment offset value group is valid (step S31; YES), whether setting is in a service mode at present or not is determined (step S32), and when the setting is not in a service mode (step S32; NO), the print adjustment offset value group for the recording-media supplying trays T1 to T3 to be used is read out from the nonvolatile memory 14 (step S33).

After step S33, change, such as addition or subtraction, is made to a print adjustment standard value for each print adjustment item included in the print adjustment standard value group on the basis of the read-out print adjustment offset value group, and as a result of this, a print adjustment value (referred to as temporary print adjustment value) based on the print adjustment offset value group is calculated. Furthermore, when a new print adjustment offset value group is inputted and the "OK" button shown by reference mark Ch5 is touched, the temporary print adjustment value is changed by addition, subtraction or the like on the basis of the new print adjustment offset value group, and the final print adjustment value is calculated (step S34). At this time, the print adjustment offset value group stored in the nonvolatile memory 14 is renewed to the new print adjustment offset value group.

Whether the final print adjustment values calculated in step S34 coincide with the print adjustment standard value group or not, that is, whether the final print adjustment values are zero (zero on all items) or not is determined (step S35). In case of not coinciding with the print adjustment standard value group (step S35; NO), the effect that the final print adjustment values are valid is displayed on the basic operation screen (step S36), and process goes to step S37.

In case that the final print adjustment values coincide with the print adjustment standard value group in step S35 (step S35; YES), process goes to step S37 without processing of step S36.

In step S37, the above-described final print adjustment values are converted to executable data. In next step S38, the execution data is stored in the embedded memory of the control section 15.

When a print adjustment offset value group is invalid in step S31 (step S31; NO) or when setting is in a service mode at present in step S32 (step S32; YES), process goes to step S39.

In step S39, the print adjustment standard value group is set as print adjustment values. However, when a new print adjustment offset value group is inputted and the "OK" button shown by reference mark Ch5 is touched, the print adjustment standard value group is added, subtracted or the like on the basis of the new print adjustment offset value group. Concequently the final print adjustment values are calculated and process goes to step S37.

Accordingly, by inputting a print adjustment offset value group for each of the recording-media supplying trays T1 to T3 and for each side of printer sheet with preservation of a print adjustment standard value group (without deletion), fine adjustment of the print adjustment standard value group is possible. Therefore it is possible to perform detailed print adjustment for various paper types without resetting a print adjustment value anew at each print processing.

Furthermore it is possible to avoid a situation in which a serviceman must re-input a print adjustment standard value group, because the print adjustment standard value group is maintained without being erased.

Furthermore it is possible to improve operationality because detailed print adjustment using a print adjustment offset value group can be performed as a whole on each of the recording-media supplying trays T1 to T3.

Furthermore it is possible to check easily whether a print adjustment offset value group is set on each of the recording-media supplying trays T1 to T3 or not, from basic operation screen. Therefore it is possible to determine easily and promptly whether to clear the offset value and re-input an offset value anew or to use the offset value group on each of the recording-media supplying trays T1 to T3. This makes it possible to avoid a situation such as that in which print adjustment values set for another paper type (for example, the print adjustment values set for the paper type used on the last printing process) is used mistakenly.

Furthermore it is convenient because every offset value of all print adjustment items included in a print adjustment offset value group which is set at present can be cleared on each of the recording-media supplying trays T1 to T3 collectively.

Furthermore a currently valid print adjustment offset value group can be invalidate with preservation without deletion. Therefore it is possible to respond to a user using only a print adjustment standard value group without input/deletion of a print adjustment offset value group for each use.

Furthermore if a serviceman re-inputs a print adjustment standard value group, a currently valid print adjustment offset value group is automatically invalidated without the necessity of being invalidated manually or deleted from the nonvolatile memory 14. Therefore with preservation of the group, the serviceman can re-input a print adjustment standard value group, and thus it is possible to improve efficiency of the serviceman's work. Because it is thus possible to independently adjust (input) a print adjustment standard value group and a print adjustment offset value group, which includes that The print adjustment offset value group already stored in the nonvolatile memory 14 is applied to re-inputted print adjustment standard value group, the apparatus has high adjustability.

The description of the embodiment shows an example of an image forming apparatus and an image forming method according to the present invention, but is not limited thereto. Detail configuration and operation of the image forming apparatus 100 in the embodiment may be modified optionally without departing from the intent of the present invention.

For example, the present invention is not limited to a printer sheet sheet but applicable to various recording-media for printing, such as an OHP. The image forming apparatus 100 is assumed to be a printer capable of color printing, but not limited thereto. The present invention is applicable also to a printer for black-and-white printing and the like.

Figure 14:
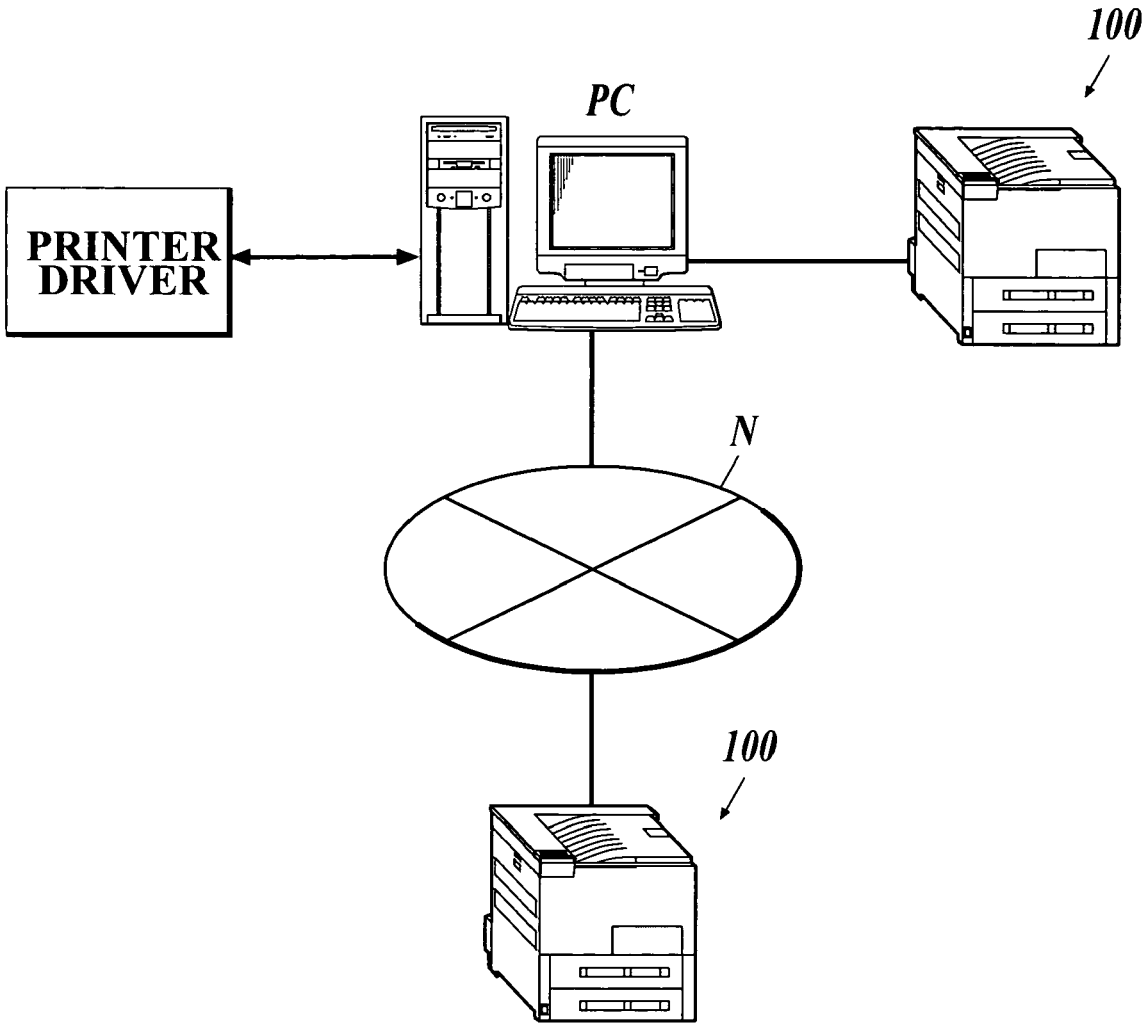
FIG. 14 is a view showing a frame format of a configuration in which an image forming apparatus to which the present invention is applied.

A print adjustment offset value group is inputted through the operating section 16 in the embodiment, but not limited thereto. For example, as shown in FIG. 14, in those instances where the image forming apparatus 100 is a network printer comprising a network interface capable of connecting to an information equipment such as a PC (Personal Computer) through a network N such as a LAN, and in those instances where the image forming apparatus 100 is a local printer comprising a serial port, parallel port or a USB port capable of directly connecting to an information equipment such as a PC, it is inputted through a printer driver provided for the information equipment such as a PC.

According to the embodiments, print adjustment is performed for each of two sides of a recording medium depending on an adjustment value for each side in duplex printing which is stored as being related to a type of a recording medium or the recording-media supplying tray. From this, print adjustment is possible for each type of a recording medium and each recording-media supplying tray collectively. Therefore it is possible to restrain input of adjustment values for each print processing. Also the print adjustment can be performed efficiently and a high-quality printed image can be obtain easily.

The storing section may store the adjustment value related to the recording-media supplying tray, thereby the print adjustment can be performed more efficiently and a high-quality printed image can be obtain easily.

The apparatus may comprise a plurality of recording-media supplying trays, and the storing section may store the adjustment value related to at least one of the plurality of recording-media supplying trays, thereby, because an adjustment value is stored as being related to at least one of a plurality of recording-media supplying trays, print adjustment in duplex printing is possible without re-inputting print adjustment value anew at each print processing when the recording-media supplying tray related to the adjustment value is used. Therefore print adjustment, such as ptint magnification adjustment or print position adjustment, can be performed efficiently and a high-quality printed image can be obtain easily.

The apparatus may comprise a plurality of recording-media supplying trays, and may further comprise an instructing section for giving an instruction for relating the adjustment value to the recording-media supplying trays, thereby print adjustment is possible collectively for each recording-media supplying tray depending on use conditions because it is possible to direct to relate an adjustment value to a recording-media supplying tray. Therefore the print adjustment can be performed efficiently.

The storing section may store the adjustment value related to the type of the recording medium, thereby print adjustment can be performed collectively for each type of a recording medium because an adjustment value is stored as being related to a type of a recording medium. Therefore the print adjustment can be performed efficiently.

The type of the recording medium may be classified based on a basis weight of the recording medium, thereby print adjustment can be performed collectively for each basis weight of a recording medium because a type of the recording medium is classified based on a basis weight of the recording medium. Therefore the print adjustment can be performed efficiently and most suitable print adjustment for the basis weight can be performed.

The type of the recording medium may be classified based on whether the recording medium are coated paper or not, thereby print adjustment can be performed collectively for each of coated paper and uncoated paper because the recording medium are classified based on whether the recording medium are coated paper or not. Therefore the print adjustment can be performed efficiently.

The image forming apparatus may comprise an instructing section for giving an instruction for relating the adjustment value to the recording-media supplying trays, thereby print adjustment is possible collectively for each type of a recording medium depending on use conditions because it is possible to instruct to relate an adjustment value to a type of recording paper. Therefore the print adjustment can be performed efficiently.

A name representing the adjustment value may be given to the adjustment value and the adjustment value is stored with relation to the name in the storing section, thereby, because a name is given to an adjustment value and stored, the adjustment value can be managed by the name.

The control section may read out the adjustment value in accordance with the name and control the print section based on the read-out adjustment value, thereby, because it is possible to read out an adjustment value based on the name given to the adjustment value and perform print adjustment, the adjustment value according to a type of a recording medium or a recording-media supplying tray is made available easily and promptly if only the name is indicated, and so operationality is improved. Therefore because a detail print adjustment using an adjustment value can be perform by simple operation, a high-quality printed image can be obtained easily.

The image forming apparatus may comprise a display unit, wherein the control section may control the display unit to display a name representing the adjustment value which is set for a predetermined recording-media supplying tray at present so that the name is associated with the recording-media supplying tray, thereby, because the adjustment value which is set for a predetermined recording-media supplying tray at present is associated with the recording-media supplying tray and displayed on the display unit, a user can easily confirm whether an adjustment value is set for the recording-media supplying tray at present or not. Treatment of an adjustment value is made very easy, which includes that it is easy to set or assign a suitable adjustment value.

The control section may control the display unit to display the name on a basic operation screen of the display unit, thereby, because a name representing an adjustment value is displayed on a basic operation screen, a user can easily grasp whether an adjustment value is set or not by seeing the basic operation screen. Therefore Treatment of an adjustment value is made very easy, which includes that it is easy to set or assign a suitable adjustment value.

The image forming apparatus may comprise a display unit, wherein the control section may control the display section to display that the adjustment value is stored when the adjustment value is related to the type of the recording medium or the recording-media supplying tray and stored in the storing section, thereby, because the display unit displays unit that the adjustment value is stored when the adjustment value is related to the type of the recording medium or the recording-media supplying tray and stored in the storing section, a user can easily confirm whether an adjustment value is set for the type of a recording medium or the recording-media supplying tray at present or not. Treatment of an adjustment value is made very easy, which includes that it is easy to set or assign a suitable adjustment value.

The storing section may store a plurality of the adjustment values related to the type of the recording medium or the recording-media supplying tray, thereby a plurality of adjustment values are stored as being related to the type of the recording medium or the recording-media supplying tray. From this, a plurality of adjustment values can be set for each type of a recording medium or each recording-media supplying tray collectively, print adjustment can be performed efficiently and a higher quality printed image can be obtained. Also it is possible to choose and set a plurality of adjustment values to be suitable for each type of a recording medium or each recording-media supplying tray.

The storing section may store an adjustment standard value for printing the image to the recording medium in the print section and the adjustment value related to the recording-media supplying tray, and the control section may select the adjustment value from the storing section depending on the recording-media supplying tray storing the recording medium to be printed on in the printing section, and control the print section based on the selected adjustment value and the adjustment standard value, thereby an adjustment standard value for printing the image to the recording medium in the print section and the adjustment value related to the recording-media supplying tray are stored, and the stored adjustment value is selected depending on the recording-media supplying tray storing the recording medium to be printed on in the printing section, and print adjustment is performed based on the selected adjustment value and the adjustment standard value. Therefore because fine adjustment of the adjustment standard value can be performed by using the adjustment value for each recording-media supplying tray collectively, the print adjustment can be performed more efficiently and a high-quality printed image can be obtain easily.

The storing section may store an adjustment standard value for printing the image to the recording medium in the print section and the adjustment value related to the recording-media supplying tray, and the control section may select the adjustment value from the storing section depending on the type of the recording medium to be printed on in the printing section, and control the print section based on the selected adjustment value and the adjustment standard value, thereby an adjustment standard value for printing the image to the recording medium in the print section and the adjustment value related to the type of a recording medium are stored, and the stored adjustment value is selected depending on the type of a recording medium storing the recording medium to be printed on in the printing section, and print adjustment is performed based on the selected adjustment value and the adjustment standard value. Therefore because fine adjustment of the adjustment standard value can be performed by using the adjustment value for each type of a recording medium collectively, the print adjustment can be performed more efficiently and a high-quality printed image can be obtain easily.

The adjustment standard value may be stored in the storing section for each of the two sides of the recording medium, thereby an adjustment standard value is stored for each of the two sides of the recording medium. Therefore print adjustment based on the adjustment standard value can be performed for each side of a recording medium to be printed on.

The storing section may store an adjustment standard value group containing a plurality of the adjustment standard values, thereby an adjustment standard value group containing a plurality of the adjustment standard values is stored. Therefore because it is possible to perform setting settings in units of adjustment value groups for each type of a recording medium or each recording-media supplying tray collectively, print adjustment can be performed efficiently.

The storing section may store an adjustment value group containing a plurality of the adjustment values, thereby an adjustment value group containing a plurality of the adjustment values is stored. Therefore because it is possible to perform setting settings in units of adjustment value groups for each type of a recording medium or each recording-media supplying tray collectively, print adjustment can be performed efficiently.

When at least one of the adjustment values which are set for the predetermined recording-media supplying tray at present is changed, the control section may control the display unit not to display the name of the adjustment value, thereby, when at least one of the adjustment values which are set for a recording-media supplying tray at present is changed, the name of the adjustment value is not displayed on the display unit. Therefore a user can easily confirm the adjustment value is changed, and Treatment of an adjustment value is made very easy, which includes that it is easy to set or assign a suitable adjustment value.

The control section may delete the adjustment value group stored in the storing section collectively depending on an inputted instruction, thereby an adjustment value group stored in the storing section is deleted collectively depending on an inputted instruction. Therefore conveniently all adjustment values included in an adjustment value group set for each type of a recording medium or each recording-media supplying tray can be cleared (deleted) collectively.

The storing section may store flag information representing whether print adjustment is performed by using the adjustment value or not, the control section may determine whether the print adjustment is performed by using the adjustment value based on the flag information or not, thereby, because a currently valid adjustment value group can be invalidated with preservation without deletion. Therefore it is possible to respond to a user using only an adjustment standard value group without input/deletion of an adjustment value group for each use.

The control section may take control so that the print adjustment using the adjustment value is not performed while the adjustment standard value is inputted, thereby the print adjustment using the adjustment value is controlled not to be performed while the adjustment standard value is inputted. Therefore, for example, when a serviceman re-inputs a print adjustment standard value group, a currently valid adjustment value group is automatically invalidated without the necessity of being invalidated manually or deleted from the storing section. Therefore with preservation of the group, the serviceman can re-input an adjustment standard value group, and thus it is possible to improve efficiency of the serviceman's work.

The storing section may be nonvolatile memory, thereby, because the storing section is a nonvolatile memory, memory content can be preserved even if the power is turned off. Therefore efficient print adjustment is possible.

According to the embodiments, an adjustment offset value group for an adjustment value group is given a name and stored. The adjustment offset value group is managed with the name. Therefore a plurality of groups of adjustment offset values corresponding to various paper types become available easily and quickly by only designation of a name, and thus it is possible to improve operationality. Therefore because detailed print adjustment using an adjustment offset value group can be performed with simple operation, it is possible to easily obtain high quality images.

Furthermore because an adjustment value group is set for each recording-media supplying tray collectively, print adjustment can be performed efficiently.

Furthermore because an adjustment value group is read out by specifying its name, management of the adjustment value group becomes very easy when what represents a paper type or the like is used for the name, which includes that a user can confirm the content of an adjustment value group easily and assignment of an adjustment value group is very easy.

Furthermore a print adjustment value does not have to be reset for each print processing, and it is possible to avoid such an unexpected situation as setting failure which may be caused by frequent prind adjustment.

Furthermore in case of using again a type of a print sheet used before, conveniently the print adjustment value for the paper type does not have to be set anew.

The control section may control the name representing the adjustment value group which is set for the predetermined recording-media supplying tray at present to be displayed on a basic operation screen so as to relate the name to the predetermined recording-media supplying tray, thereby what adjustment value group is set and for which recording-media supplying tray the adjustment value group is set at present can be confirmed easily and quickly because the name of the adjustment value group is displayed on a basic operation screen.

When at least one of each of the adjustment values of the adjustment value group which is applied to the predetermined recording-media supplying tray at present is changed, the control section may control the name of the adjustment value group not to be displayed on the basic operation screen, thereby, when at least one of the adjustment values which are set for a recording-media supplying tray at present is changed, the name of the adjustment value is not displayed on the display unit. Therefore a user can easily confirm the adjustment value is changed, and Treatment of an adjustment value is made very easy, which includes that it is easy to set or assign a suitable adjustment value.

The storing section may be nonvolatile memory, thereby, because the storing section is a nonvolatile memory, memory content can be preserved even if the power is turned off. Therefore efficient print adjustment is possible.

According to the embodiments, fine adjustment of an adjustment standard value group becomes possible by inputting an adjustment value group on each recording-media supplying tray and each side of printer sheet. Therefore it is easy to perform detailed print adjustment for various paper types without re-inputting print adjustment values anew at each print processing. Because detailed print adjustment using the adjustment value group can be performed for each recording-media supplying tray collectively, the print adjustment can be performed efficiently and a high-quality printed image can be obtain easily.

Furthermore it is possible to confirm easily whether an adjustment value group is set on each recording-media supplying tray or not from basic operation screen where basic operation is instructed and inputted. Therefore it is possible to determine easily and promptly whether to clear the adjustment value group for re-input or to use the adjustment value group on each recording-media supplying tray. This makes it possible to avoid a situation such as that in which adjustment values set for another paper type (for example, the adjustment values set for the paper type used on the last printing process) is used mistakenly.

The control section may take control so that all of the adjustment values included in the adjustment value group are deleted from the storing section collectively depending on an inputted instruction, thereby conveniently every offset value of all print adjustment items included in a currently valid adjustment value group can be cleared (erased) on each recording-media supplying tray collectively. Also, it is possible to avoid a situation in which a serviceman must re-input an adjustment standard value group, because the adjustment standard value group is preserved without being erased.

The storing section may further store flag information for instructing the control section whether the print adjustment is performed by using the adjustment value group or not, and the control section may take control so that the print adjustment using the adjustment value group is performed or not, based on the flag information, thereby, because a currently valid adjustment value group can be invalidated with preservation without deletion. Therefore it is possible to respond to a user using only an adjustment standard value group without input/deletion of an adjustment value group for each use.

The control section may take control so that the print adjustment using the adjustment value group is not performed while the adjustment standard value group is inputted, thereby, when a serviceman re-inputs a print adjustment standard value group, a currently valid adjustment value group is automatically invalidated without the necessity of being invalidated manually or deleted from the storing section. Therefore with preservation of the group, the serviceman can re-input an adjustment standard value group, and thus it is possible to improve efficiency of the serviceman's work. Because it is possible to independently adjust (input) a print adjustment standard value group and an adjustment value group, which includes the adjustment value group which has been already stored in the nonvolatile memory is applied to re-inputted adjustment standard value group, the apparatus has high adjustability.

The storing section may be nonvolatile memory, thereby, because the storing section is a nonvolatile memory, memory content can be preserved even if the power is turned off. Therefore efficient print adjustment is possible.

According to the embodiments, print adjustment is performed for each side of a recording medium depending on an adjustment value for each side in duplex printing which is stored as being related to a type of a recording medium or the recording-media supplying tray. From this, print adjustment is possible for each type of a recording medium and each recording-media supplying tray collectively. Therefore it is possible to restrain input of adjustment values for each print processing. Also the print adjustment can be performed efficiently and a high-quality printed image can be obtain easily.

The image forming method may further comprise storing the adjustment value related to the recording-media supplying tray in the storing section, thereby the print adjustment can be performed more efficiently and a high-quality printed image can be obtain easily.

The apparatus may comprise a plurality of recording-media supplying trays, and the method further may comprise storing the adjustment value related to at least one of the plurality of recording-media supplying trays in the storing section, thereby, because an adjustment value is stored as being related to at least one of a plurality of recording-media supplying trays, print adjustment in duplex printing is possible without re-inputting print adjustment value anew at each print processing when the recording-media supplying tray related to the adjustment value is used. Therefore print adjustment, such as ptint magnification adjustment or print position adjustment, can be performed efficiently and a high-quality printed image can be obtain easily.

The apparatus may comprise a plurality of recording-media supplying trays, and the method further may comprise giving an instruction for relating the adjustment value to the recording-media supplying trays, thereby print adjustment is possible collectively for each recording-media supplying tray depending on use conditions because it is possible to instruct to relate an adjustment value to a recording-media supplying tray. Therefore the print adjustment can be performed efficiently.

The image forming method may further comprise storing the adjustment value related to the type of the recording medium in the storing section, thereby print adjustment can be performed collectively for each type of a recording medium because an adjustment value is stored as being related to a type of a recording medium. Therefore the print adjustment can be performed efficiently.

The type of the recording medium may be classified based on a basis weight of the recording medium, thereby print adjustment can be performed collectively for each basis weight of a recording medium because a type of the recording medium is classified based on a basis weight of the recording medium. Therefore the print adjustment can be performed efficiently and most suitable print adjustment for the basis weight can be performed.

The type of the recording medium may be classified based on whether the recording medium are coated paper or not, thereby print adjustment can be performed collectively for each of coated paper and uncoated paper because the recording medium are classified based on whether the recording medium are coated paper or not. Therefore the print adjustment can be performed efficiently.

The image forming method may further comprise giving an instruction for relating the adjustment value to the recording-media supplying trays, thereby print adjustment is possible collectively for each type of a recording medium depending on use conditions because it is possible to instruct to relate an adjustment value to a type of recording paper. Therefore the print adjustment can be performed efficiently.

The image forming method may further comprise giving a name representing the adjustment value to the adjustment value, wherein the value is stored with relation to the name in the storing section, thereby, because a name is given to an adjustment value and stored, the adjustment value can be managed by the name.

The image forming method may further comprise:

reading out the adjustment value in accordance with the name; and controlling the print section based on the read-out adjustment value, thereby, because it is possible to read out an adjustment value based on the name given to the adjustment value and perform print adjustment, the adjustment value according to a type of a recording medium or a recording-media supplying tray is made available easily and promptly if only the name is indicated, and so operationality is improved. Therefore because a detail print adjustment using an adjustment value can be perform by simple operation, a high-quality printed image can be obtained easily.

The image forming apparatus may comprise a display unit, and the method may further comprise controlling the display unit to display a name representing the adjustment value which is set for a predetermined recording-media supplying tray at present so that the name is associated with the recording-media supplying tray, thereby, because the adjustment value which is set for a predetermined recording-media supplying tray at present is associated with the recording-media supplying tray and displayed on the display unit, a user can easily confirm whether an adjustment value is set for the recording-media supplying tray at present or not. Treatment of an adjustment value is made very easy, which includes that it is easy to set or assign a suitable adjustment value.

The image forming method may further comprise controlling the display unit to display the name on a basic operation screen of the display unit, thereby, because a name representing an adjustment value is displayed on a basic operation screen, a user can easily grasp whether an adjustment value is set or not by seeing the basic operation screen. Therefore Treatment of an adjustment value is made very easy, which includes that it is easy to set or assign a suitable adjustment value.

The image forming apparatus comprises a display unit, and the method may further comprise controlling the display section to display that the adjustment value is stored when the adjustment value is related to the type of the recording medium or the recording-media supplying tray and stored in the storing section, thereby, because the display unit displays unit that the adjustment value is stored when the adjustment value is related to the type of the recording medium or the recording-media supplying tray and stored in the storing section, a user can easily confirm whether an adjustment value is set for the type of a recording medium or the recording-media supplying tray at present or not. Treatment of an adjustment value is made very easy, which includes that it is easy to set or assign a suitable adjustment value.

The image forming method may further comprise storing a plurality of the adjustment values related to the type of the recording medium or the recording-media supplying tray in the storing section, thereby a plurality of adjustment values are stored as being related to the type of the recording medium or the recording-media supplying tray. From this, a plurality of adjustment values can be set for each type of a recording medium or each recording-media supplying tray collectively, print adjustment can be performed efficiently and a higher quality printed image can be obtained. Also it is possible to choose and set a plurality of adjustment values to be suitable for each type of a recording medium or each recording-media supplying tray.

The image forming method may further comprise selecting the adjustment value from the storing section depending on the recording-media supplying tray storing the recording medium to be printed on in the printing section, wherein the print section is controlled based on the selected adjustment value and the adjustment standard value for printing the image on the recording medium in the print section, thereby an adjustment standard value for printing the image to the recording medium in the print section and the adjustment value related to the recording-media supplying tray are stored, and the stored adjustment value is selected depending on the recording-media supplying tray storing the recording medium to be printed on in the printing section, and print adjustment is performed based on the selected adjustment value and the adjustment standard value. Therefore because fine adjustment of the adjustment standard value can be performed by using the adjustment value for each recording-media supplying tray collectively, the print adjustment can be performed more efficiently and a high-quality printed image can be obtain easily.

The image forming method may further comprise selecting the adjustment value from the storing section depending on the type of the recording medium to be printed on in the printing section, wherein the print section is controlled based on the selected adjustment value and an adjustment standard value for printing the image on the recording medium in the print section, thereby an adjustment standard value for printing the image to the recording medium in the print section and the adjustment value related to the type of a recording medium are stored, and the stored adjustment value is selected depending on the type of a recording medium storing the recording medium to be printed on in the printing section, and print adjustment is performed based on the selected adjustment value and the adjustment standard value. Therefore because fine adjustment of the adjustment standard value can be performed by using the adjustment value for each type of a recording medium collectively, the print adjustment can be performed more efficiently and a high-quality printed image can be obtain easily.

The adjustment standard value may be stored in the storing section for each of the two sides of the recording medium, thereby an adjustment standard value is stored for each of the two sides of the recording medium. Therefore print adjustment based on the adjustment standard value can be performed for each side of a recording medium to be printed on.

An adjustment standard value group containing a plurality of the adjustment standard values may be stored in the storing section, thereby an adjustment standard value group containing a plurality of the adjustment standard values is stored. Therefore because it is possible to perform setting settings in units of adjustment value groups for each type of a recording medium or each recording-media supplying tray collectively, print adjustment can be performed efficiently.

An adjustment value group containing a plurality of the adjustment values may be stored in the storing section, thereby an adjustment value group containing a plurality of the adjustment values is stored. Therefore because it is possible to perform setting settings in units of adjustment value groups for each type of a recording medium or each recording-media supplying tray collectively, print adjustment can be performed efficiently.

The display unit may be controlled not to display the name of the adjustment value when at least one of the adjustment values which are set for the predetermined recording-media supplying tray at present is changed, thereby, when at least one of the adjustment values which are set for a recording-media supplying tray at present is changed, the name of the adjustment value is not displayed on the display unit. Therefore a user can easily confirm the adjustment value is changed, and Treatment of an adjustment value is made very easy, which includes that it is easy to set or assign a suitable adjustment value.

The image forming method may further comprise deleting the adjustment value group stored in the storing section collectively depending on an inputted instruction, thereby an adjustment value group stored in the storing section is deleted collectively depending on an inputted instruction. Therefore conveniently all adjustment values included in an adjustment value group set for each type of a recording medium or each recording-media supplying tray can be cleared (deleted) collectively.

The image forming method may further comprise:

storing flag information representing whether print adjustment is performed by using the adjustment value or not, in the storing section; and determining whether the print adjustment is performed by using the adjustment value based on the flag information or not, thereby, because a currently valid adjustment value group can be invalidated with preservation without deletion. Therefore it is possible to respond to a user using only an adjustment standard value group without input/deletion of an adjustment value group for each use.

The print section may be controlled so that the print adjustment using the adjustment value is not performed while the adjustment standard value is inputted, thereby the print adjustment using the adjustment value is controlled not to be performed while the adjustment standard value is inputted. Therefore, for example, when a serviceman re-inputs a print adjustment standard value group, a currently valid adjustment value group is automatically invalidated without the necessity of being invalidated manually or deleted from the storing section. Therefore with preservation of the group, the serviceman can re-input an adjustment standard value group, and thus it is possible to improve efficiency of the serviceman's work.

The storing section may be nonvolatile memory, thereby, because the storing section is a nonvolatile memory, memory content can be preserved even if the power is turned off. Therefore efficient print adjustment is possible.

According to the embodiments, an adjustment offset value group for an adjustment value group is given a name and stored. The adjustment offset value group is managed with the name. Therefore a plurality of groups of adjustment offset values corresponding to various paper types become available easily and quickly by only designation of a name, and thus it is possible to improve operationality. Therefore because detailed print adjustment using an adjustment offset value group can be performed with simple operation, it is possible to easily obtain high quality images.

Furthermore because an adjustment value group is set for each recording-media supplying tray collectively, print adjustment can be performed efficiently.

Furthermore because an adjustment value group is read out by specifying its name, management of the adjustment value group becomes very easy when what represents a paper type or the like is used for the name, which includes that a user can confirm the content of an adjustment value group easily and assignment of an adjustment value group is very easy.

Furthermore a print adjustment value does not have to be reset for each print processing, and it is possible to avoid such an unexpected situation as setting failure which may be caused by frequent prind adjustment.

Furthermore in case of using again a type of a print sheet used before, conveniently the print adjustment value for the paper type does not have to be set anew.

The image forming method may further comprise controling the name representing the adjustment value group which is set for the predetermined recording-media supplying tray at present to be displayed on a basic operation screen so as to relate the name to the predetermined recording-media supplying tray, thereby what adjustment value group is set and for which recording-media supplying tray the adjustment value group is set at present can be confirmed easily and quickly because the name of the adjustment value group is displayed on a basic operation screen.

The image forming method may further comprise taking control so that the name of the adjustment value group is not displayed on the basic operation screen when at least one of each of the adjustment values of the adjustment value group which is applied to the predetermined recording-media supplying tray at present is changed, thereby, when at least one of the adjustment values which are set for a recording-media supplying tray at present is changed, the name of the adjustment value is not displayed on the display unit. Therefore a user can easily confirm the adjustment value is changed, and Treatment of an adjustment value is made very easy, which includes that it is easy to set or assign a suitable adjustment value.

The storing section may be nonvolatile memory, thereby, because the storing section is a nonvolatile memory, memory content can be preserved even if the power is turned off. Therefore efficient print adjustment is possible.

According to the embodiments, fine adjustment of an adjustment standard value group becomes possible by inputting an adjustment value group on each recording-media supplying tray and each side of printer sheet. Therefore it is easy to perform detailed print adjustment for various paper types without re-inputting print adjustment values anew at each print processing. Because detailed print adjustment using the adjustment value group can be performed for each recording-media supplying tray collectively, the print adjustment can be performed efficiently and a high-quality printed image can be obtain easily.

Furthermore it is possible to confirm easily whether an adjustment value group is set on each recording-media supplying tray or not from basic operation screen where basic operation is instructed and inputted. Therefore it is possible to determine easily and promptly whether to clear the adjustment value group for re-input or to use the adjustment value group on each recording-media supplying tray. This makes it possible to avoid a situation such as that in which adjustment values set for another paper type (for example, the adjustment values set for the paper type used on the last printing process) is used mistakenly.

The image forming method may further comprise taking control so that all of the adjustment values included in the adjustment value group are deleted from the storing section collectively depending on an inputted instruction, thereby conveniently every offset value of all print adjustment items included in a currently valid adjustment value group can be cleared (erased) on each recording-media supplying tray collectively. Also, it is possible to avoid a situation in which a serviceman must re-input an adjustment standard value group, because the adjustment standard value group is preserved without being erased.

The image forming method may further comprise:

storing flag information for instructing the control section whether the print adjustment is performed by using the adjustment value group or not in the storing section; and taking control so that the print adjustment using the adjustment value group is preformed or not, based on the flag information, thereby, because a currently valid adjustment value group can be invalidated with preservation without deletion. Therefore it is possible to respond to a user using only an adjustment standard value group without input/deletion of an adjustment value group for each use.

The image forming method may further comprise taking control so that the print adjustment using the adjustment value group is not performed while the adjustment standard value group is inputted, thereby, when a serviceman re-inputs a print adjustment standard value group, a currently valid adjustment value group is automatically invalidated without the necessity of being invalidated manually or deleted from the storing section. Therefore with preservation of the group, the serviceman can re-input an adjustment standard value group, and thus it is possible to improve efficiency of the serviceman's work. Because it is possible to independently adjust (input) a print adjustment standard value group and an adjustment value group, which includes the adjustment value group which has been already stored in the nonvolatile memory is applied to re-inputted adjustment standard value group, the apparatus has high adjustability.

The storing section may be nonvolatile memory, thereby, because the storing section is a nonvolatile memory, memory content can be preserved even if the power is turned off. Therefore efficient print adjustment is possible.

The entire disclosure of Japanese Patent Applications No. Tokugan 2004-233497 filed on Aug. 10, 2004, No. Tokugan 2003-353537 filed on Oct. 14, 2003 and No. Tokugan 2003-353547 filed on Oct. 14, 2003, including specification, claims, drawings and summary are incorporated herein by reference in its entirety.

What is claimed is:

1. An image forming apparatus comprising:

a recording-media supplying tray for storing a recording medium;

a print section for printing an image on the recording medium;

a storing section for storing an adjustment value for a printing of the image in the print section related to a type of the recording medium or the recording-media supplying tray for each of two sides of the recording medium; and a control section for controlling the print section so that the printing of the image is adjusted for each of the two sides depending on the adjustment value for each of the two sides, which is stored in the storing section.

2. The apparatus of claim 1, wherein the storing section stores the adjustment value related to the recording-media supplying tray.

3. The apparatus of claim 1 comprising a plurality of recording-media supplying trays, wherein the storing section stores the adjustment value related to at least one of the plurality of recording-media supplying trays.

4. The apparatus of claim 1 comprising a plurality of recording-media supplying trays, and the apparatus further comprising an instructing section for giving an instruction for relating the adjustment value to the recording-media supplying trays.

5. The apparatus of claim 1, wherein the storing section stores the adjustment value related to the type of the recording medium.

6. The apparatus of claim 5, wherein the type of the recording medium is classified based on a basis weight of the recording medium.

7. The apparatus of claim 5, wherein the type of the recording medium is classified based on whether the recording medium are coated paper or not.

8. The apparatus of claim 5 comprising an instructing section for giving an instruction for relating the adjustment value to the recording-media supplying trays.

9. The apparatus of claim 1, wherein a name representing the adjustment value is given to the adjustment value and the adjustment value is stored with relation to the name in the storing section.

10. The apparatus of claim 9, wherein the control section reads out the adjustment value in accordance with the name and controls the print section based on the read-out adjustment value.

11. The apparatus of claim 1 comprising a display unit, wherein the control section controls the display unit to display a name representing the adjustment value which is set for a predetermined recording-media supplying tray at present so that the name is associated with the recording-media supplying tray.

12. The apparatus of claim 11, wherein the control section controls the display unit to display the name on a basic operation screen of the display unit.

13. The apparatus of claim 1 comprising a display unit, wherein the control section controls the display section to display that the adjustment value is stored when the adjustment value is related to the type of the recording medium or the recording-media supplying tray and stored in the storing section.

14. The apparatus of claim 1, wherein the storing section stores a plurality of the adjustment values related to the type of the recording medium or the recording-media supplying tray.

15. The apparatus of claim 1, wherein the storing section stores an adjustment standard value for printing the image to the recording medium in the print section and the adjustment value related to the recording-media supplying tray, and the control section selects the adjustment value from the storing section depending on the recording-media supplying tray storing the recording medium to be printed on in the printing section, and controls the print section based on the selected adjustment value and the adjustment standard value.

16. The apparatus of claim 1, wherein the storing section stores an adjustment standard value for printing the image to the recording medium in the print section and the adjustment value related to the recording-media supplying tray, and the control section selects the adjustment value from the storing section depending on the type of the recording medium to be printed on in the printing section, and controls the print section based on the selected adjustment value and the adjustment standard value.

17. The apparatus of claim 15, wherein the adjustment standard value is stored in the storing section for each of the two sides of the recording medium.

18. The apparatus of claim 16, wherein the adjustment standard value is stored in the storing section for each of the two sides of the recording medium.

19. The apparatus of claim 15, wherein the storing section stores an adjustment standard value group containing a plurality of the adjustment standard values.

20. The apparatus of claim 16, wherein the storing section stores an adjustment standard value group containing a plurality of the adjustment standard values.

21. The apparatus of claim 1, wherein the storing section stores an adjustment value group containing a plurality of the adjustment values.

22. The apparatus of claim 12, wherein when at least one of the adjustment values which are set for the predetermined recording-media supplying tray at present is changed, the control section controls the display unit not to display the name of the adjustment value.

23. The apparatus of claim 21, wherein the control section deletes the adjustment value group stored in the storing section collectively depending on an inputted instruction.

24. The apparatus of claim 1, wherein the storing section stores flag information representing whether print adjustment is performed by using the adjustment value or not, the control section determines whether the print adjustment is performed by using the adjustment value based on the flag information or not.

25. The apparatus of claim 15, wherein the control section takes control so that the print adjustment using the adjustment value is not performed while the adjustment standard value is inputted.

26. The apparatus of claim 16, wherein the control section takes control so that the print adjustment using the adjustment value is not performed while the adjustment standard value is inputted.

27. The apparatus of claim 1, wherein the storing section is a nonvolatile memory.

28. An image forming apparatus comprising:

a plurality of recording-media supplying trays for storing a recording medium for printing;

a storing section for storing an adjustment standard value group containing a plurality of adjustment standard values and an adjustment value group containing a plurality of adjustment values for changing the adjustment standard values of the adjustment standard value group so as to relate the adjustment standard value group and the adjustment value group to the recording-media supplying trays, respectively; and a control section for taking control so that print adjustment for the recording medium supplied from the recording-media supplying tray related to the adjustment standard value group and the adjustment value group is performed based on the adjustment standard value group and adjustment value group for each of two sides of the recording medium, wherein the control section gives a name representing the adjustment value group to the adjustment value group to store the adjustment value group in the storing section and to read out the adjustment value group based on the name.

29. The apparatus of claim 28, wherein the control section controls the name representing the adjustment value group which is set for the predetermined recording-media supplying tray at present to be displayed on a basic operation screen so as to relate the name to the predetermined recording-media supplying tray.

30. The apparatus of claim 29, wherein when at least one of each of the adjustment values of the adjustment value group which is applied to the predetermined recording-media supplying tray at present is changed, the control section controls the name of the adjustment value group not to be displayed on the basic operation screen.

31. The apparatus of claim 28, wherein the storing section is a nonvolatile memory.

32. An image forming apparatus comprising:

a plurality of recording-media supplying trays for storing a recording medium for printing;

a storing section for storing an adjustment standard value group containing a plurality of adjustment standard values and an adjustment value group containing a plurality of adjustment values for changing the adjustment standard values of the adjustment standard value group so as to relate the adjustment standard value group and the adjustment value group to the recording-media supplying trays, respectively; and a control section for taking control so that print adjustment for the recording medium supplied from the recording-media supplying tray related to the adjustment standard value group and the adjustment value group is performed based on the stored adjustment standard value group and adjustment value group for each of two sides of the recording medium, wherein in a case that the predetermined adjustment value group is related to any one of the plurality of recording-media supplying trays and stored in the storing section, the control section takes control so that information showing the case is displayed on a screen for inputting an instruction of a basic operation so as to relate the information to the recording-media supplying tray.

33. The apparatus of claim 32, wherein the control section takes control so that all of the adjustment values included in the adjustment value group are deleted from the storing section collectively depending on an inputted instruction.

34. The apparatus of claim 33, wherein the storing section further stores flag information for instructing the control section whether the print adjustment is performed by using the adjustment value group or not, and the control section takes control so that the print adjustment using the adjustment value group is performed or not, based on the flag information.

35. The apparatus of claim 32, wherein the control section takes control so that the print adjustment using the adjustment value group is not performed while the adjustment standard value group is inputted.

36. The apparatus of claim 32, wherein the storing section is a nonvolatile memory.

37. An image forming method for image forming by controlling an image forming apparatus comprising:

a recording-media supplying tray for storing a recording medium;

a print section for printing an image on the recording medium; and a storing section for storing an adjustment value for a printing of the image in the print section related to a type of the recording medium or the recording-media supplying tray for each of two sides of the recording medium, the apparatus being capable of print adjustment of the recording medium supplied from the recording-media supplying tray related to the adjustment value based on the adjustment value for each of two sides of the recording medium, the method comprising controlling the print section so that the printing of the image is adjusted for each of the two sides depending on the adjustment value for each of the two sides, which is stored in the storing section.

38. The method of claim 37 further comprising storing the adjustment value related to the recording-media supplying tray in the storing section.

39. The method of claim 37, wherein the apparatus comprises a plurality of recording-media supplying trays, and the method further comprising storing the adjustment value related to at least one of the plurality of the recording-media supplying trays in the storing section.

40. The method of claim 37, wherein the apparatus comprises a plurality of recording-media supplying trays, and the method further comprising giving an instruction for relating the adjustment value to the recording-media supplying trays.

41. The method of claim 37 further comprising storing the adjustment value related to the type of the recording medium in the storing section.

42. The method of claim 41, wherein the type of the recording medium is classified based on a basis weight of the recording medium.

43. The method of claim 41, wherein the type of the recording medium is classified based on whether the recording medium are coated paper or not.

44. The method of claim 41 further comprising giving an instruction for relating the adjustment value to the recording-media supplying trays.

45. The method of claim 37 further comprising giving a name representing the adjustment value to the adjustment value, wherein the value is stored with relation to the name in the storing section.

46. The method of claim 45 further comprising:

reading out the adjustment value in accordance with the name; and controlling the print section based on the read-out adjustment value.

47. The method of claim 37 wherein the apparatus comprises a display unit, the method further comprising controlling the display unit to display a name representing the adjustment value which is set for a predetermined recording-media supplying tray at present so that the name is associated with the recording-media supplying tray.

48. The method of claim 47 further comprising controlling the display unit to display the name on a basic operation screen of the display unit.

49. The method of claim 37 wherein the apparatus comprises a display unit, the method further comprising controlling the display section to display that the adjustment value is stored when the adjustment value is related to the type of the recording medium or the recording-media supplying tray and stored in the storing section.

50. The method of claim 37 further comprising storing a plurality of the adjustment values related to the type of the recording medium or the recording-media supplying tray in the storing section.

51. The method of claim 37 further comprising selecting the adjustment value from the storing section depending on the recording-media supplying tray storing the recording medium to be printed on in the printing section, wherein the print section is controlled based on the selected adjustment value and an adjustment standard value for printing the image on the recording medium in the print section.

52. The method of claim 37 further comprising selecting the adjustment value from the storing section depending on the type of the recording medium to be printed on in the printing section, wherein the print section is controlled based on the selected adjustment value and the adjustment standard value value for printing the image to the recording medium in the print section.

53. The method of claim 51, wherein the adjustment standard value is stored in the storing section for each of the two sides of the recording medium.

54. The method of claim 52, wherein the adjustment standard value is stored in the storing section for each of the two sides of the recording medium.

55. The method of claim 51, wherein an adjustment standard value group containing a plurality of the adjustment standard values is stored in the storing section.

56. The method of claim 52, wherein an adjustment standard value group containing a plurality of the adjustment standard values is stored in the storing section.

57. The method of claim 37, wherein an adjustment value group containing a plurality of the adjustment values is stored in the storing section.

58. The method of claim 48, wherein the display unit is controlled not to display the name of the adjustment value when at least one of the adjustment values which are set for the predetermined recording-media supplying tray at present is changed.

59. The method of claim 57 further comprising deleting the adjustment value group stored in the storing section collectively depending on an inputted instruction.

60. The method of claim 37 further comprising:

storing flag information representing whether print adjustment is performed by using the adjustment value or not, in the storing section; and determining whether the print adjustment is performed by using the adjustment value based on the flag information or not.

61. The method of claim 51, wherein the print section is controlled so that the print adjustment using the adjustment value is not performed while the adjustment standard value is inputted.

62. The method of claim 52, wherein the print section is controlled so that the print adjustment using the adjustment value is not performed while the adjustment standard value is inputted.

63. The method of claim 37, wherein the storing section is a nonvolatile memory.

64. An image forming method for image forming by controlling an image forming apparatus comprising:

a plurality of recording-media supplying trays for storing a recording medium for printing; and a storing section for storing an adjustment standard value group containing a plurality of adjustment standard values and an adjustment value group containing a plurality of adjustment values for changing the adjustment standard values of the adjustment standard value group so as to relate the adjustment standard value group and the adjustment value group to the recording-media supplying trays, respectively, the apparatus being capable of print adjustment for the recording medium supplied from the recording-media supplying tray related to the adjustment standard value group and the adjustment value group is performed based on the adjustment standard value group and adjustment value group for each of two sides of the recording medium, the method comprising:

giving a name representing the adjustment value group to the adjustment value group to store the adjustment value group in the storing section; and reading out the adjustment value group based on the name.

65. The method of claim 64 further comprising controling the name representing the adjustment value group which is set for the predetermined recording-media supplying tray at present to be displayed on a basic operation screen so as to relate the name to the predetermined recording-media supplying tray.

66. The method of claim 65 further comprising, taking control so that the name of the adjustment value group is not displayed on the basic operation screen when at least one of each of the adjustment values of the adjustment value group which is applied to the predetermined recording-media supplying tray at present is changed.

67. The method of claim 64, wherein the storing section is a nonvolatile memory.

68. An image forming method for image forming by controlling an image forming apparatus comprising:

a plurality of recording-media supplying trays for storing a recording medium for printing; and a storing section for storing an adjustment standard value group containing a plurality of adjustment standard values and an adjustment value group containing a plurality of adjustment values for changing the adjustment standard values of the adjustment standard value group so as to relate the adjustment standard value group and the adjustment value group to the recording-media supplying trays, respectively, the apparatus being capable of print adjustment for the recording medium supplied from the recording-media supplying tray related to the adjustment standard value group and the adjustment value group is performed based on the stored adjustment standard value group and adjustment value group for each of two sides of the recording medium, the method comprising, in a case that the predetermined adjustment value group is related to any one of the plurality of recording-media supplying tray and stored in the storing section, taking control so that information showing the case is displayed on a screen for inputting an instruction of a basic operation so as to relate the information to the recording-media supplying tray.

69. The method of claim 68 further comprising taking control so that all of the adjustment values included in the adjustment value group are deleted from the storing section collectively depending on an inputted instruction.

70. The method of claim 69 further comprising:

storing flag information for instructing the control section whether the print adjustment is performed by using the adjustment value group or not in the storing section; and taking control so that the print adjustment using the adjustment value group is preformed or not, based on the flag information.

71. The method of claim 68 further comprising taking control so that the print adjustment using the adjustment value group is not performed while the adjustment standard value group is inputted.

72. The method of claim 68, wherein the storing section is a nonvolatile memory.

* * * * *